US011518657B2

(12) United States Patent
Chalavon et al.

(10) Patent No.: US 11,518,657 B2
(45) Date of Patent: Dec. 6, 2022

(54) SYSTEM AND METHOD FOR REMOTE SETTING OF A TENSION IN A CRANE TRANSFER CABLE

(71) Applicant: Manitowoc Crane Group France, Dardilly (FR)

(72) Inventors: Jonathan Chalavon, Mions (FR); Patrick Combaret, Avermes (FR); Adrien Dagniaux, Yzeure (FR); Thibaud Lauretti, Villemontais (FR)

(73) Assignee: Manitowoc Crane Group France, Dardilly (FR)

( * ) Notice: Subject to any disclaimer, the term of this patent is extended or adjusted under 35 U.S.C. 154(b) by 438 days.

(21) Appl. No.: 16/841,173

(22) Filed: Apr. 6, 2020

(65) Prior Publication Data

US 2020/0317476 A1 Oct. 8, 2020

(30) Foreign Application Priority Data

Apr. 8, 2019 (FR) ..... 19/03726

(51) Int. Cl.
*B66C 11/00* (2006.01)
*B66C 11/16* (2006.01)
*B66C 19/00* (2006.01)

(52) U.S. Cl.
CPC ..... *B66C 11/16* (2013.01); *B66C 19/00* (2013.01); *B66C 2700/018* (2013.01)

(58) Field of Classification Search
CPC ... B66C 11/16; B66C 19/00; B66C 2700/018; B66C 9/14; B66C 13/10
See application file for complete search history.

(56) References Cited

U.S. PATENT DOCUMENTS 3,994,401 A * 11/1976 Tax ..... B66D 1/30 254/374

FOREIGN PATENT DOCUMENTS

EP 3415458 A1 12/2018
EP 3415458 B1 * 3/2020 ..... B66C 11/16
FR 2058699 A5 5/1971
(Continued)

OTHER PUBLICATIONS

French INPI Written Opinion and Search Report dated Feb. 26, 2020, issued in connection with FR 19/03726.

*Primary Examiner* — Emmanuel M Marcelo
(74) *Attorney, Agent, or Firm* — Cook Alex Ltd.

(57) ABSTRACT

A tension setting system for a remote setting of a tension in a transfer cable ensuring a displacement of a transfer carriage along a jib of a crane, including a winch equipped with a motor cooperating with the cable so as to ensure a displacement of the carriage, a pilot unit connected to the motor to pilot a displacement of the carriage, and a setting mechanical device mounted on the carriage and adapted to be actuated by the action of a displacement of the carriage. The setting mechanical device is coupled to the cable and configurable between a working configuration in which the mechanical device stands still irrespective of the displacement of the carriage and results in a holding of the tension in the cable, and a detent configuration in which, by the action of a displacement of the carriage piloted by the pilot unit according to a first sequence of reciprocating displacement, the mechanical device results in a release of the tension in the cable.

20 Claims, 10 Drawing Sheets

(56) References Cited

FOREIGN PATENT DOCUMENTS

| | | | | | |
|---|---|---|---|---|---|
| FR | 2398015 | A1 | | 2/1979 | |
| FR | 2456700 | A1 | | 12/1980 | |
| JP | S4844454 | B1 | | 12/1973 | |
| WO | WO-2014166574 | A1 | * | 10/2014 | ..... B66C 11/16 |

* cited by examiner

[Fig.1]
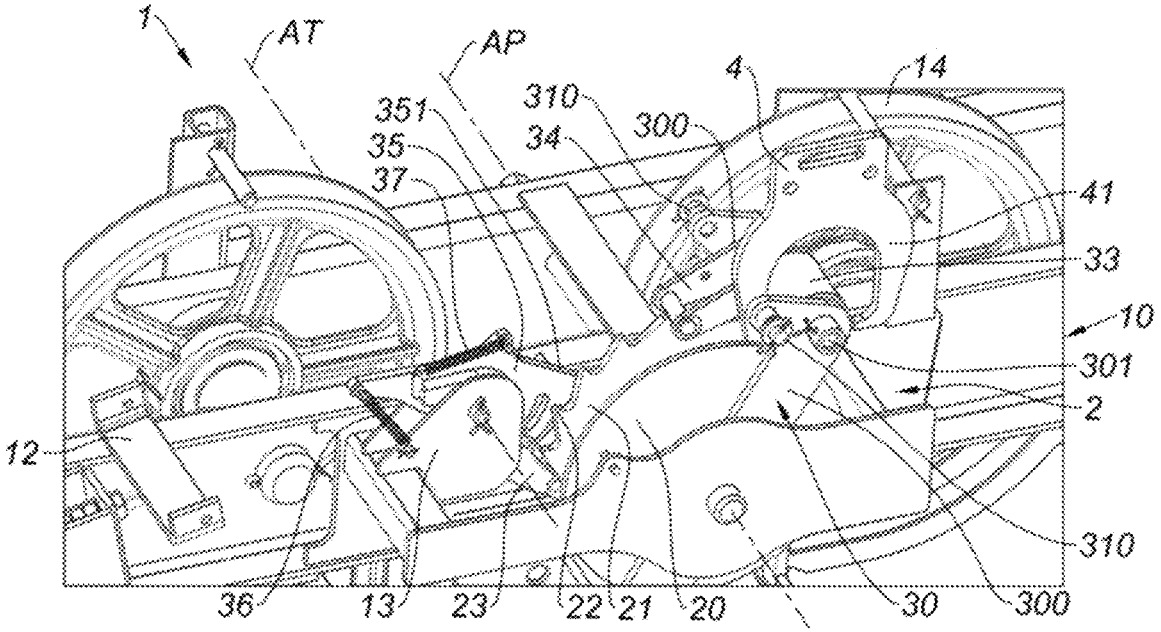
[Fig.2]
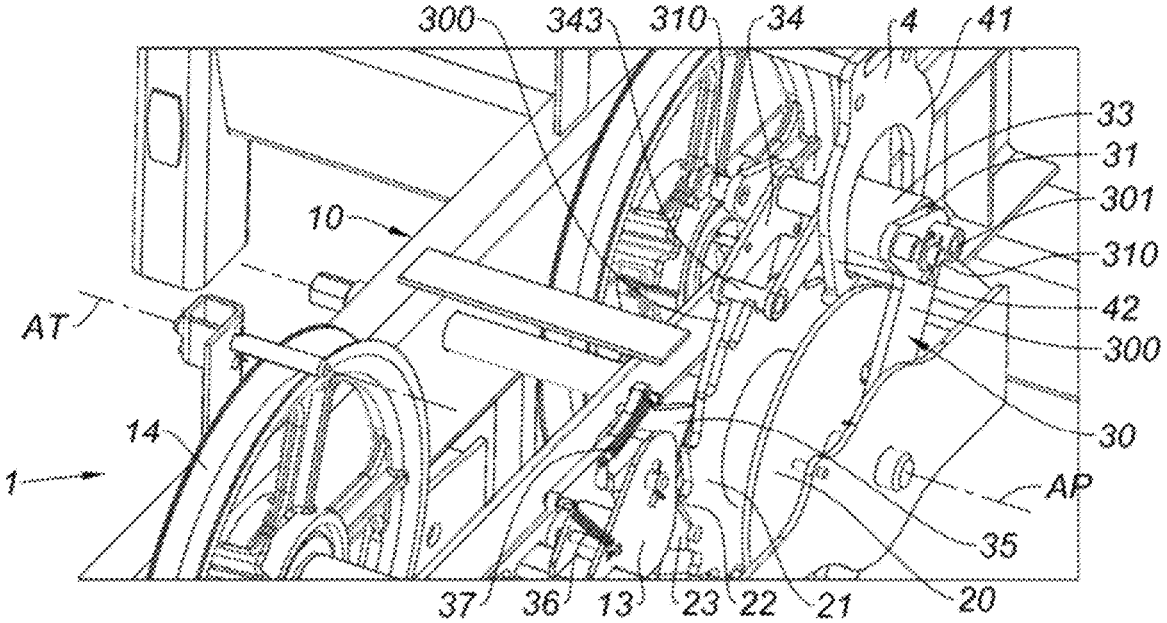

[Fig.3]
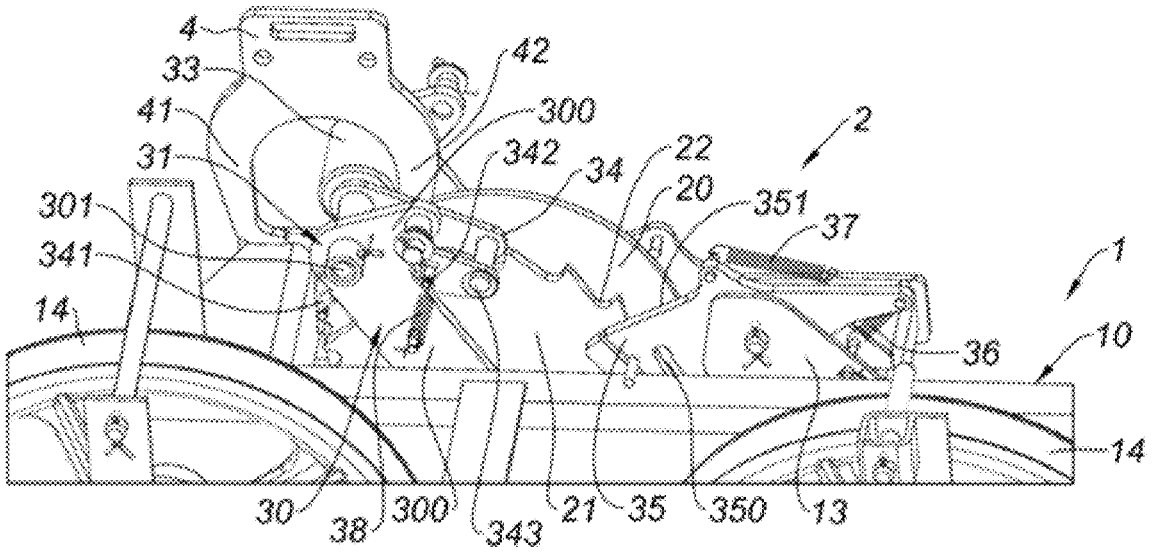
[Fig.4]
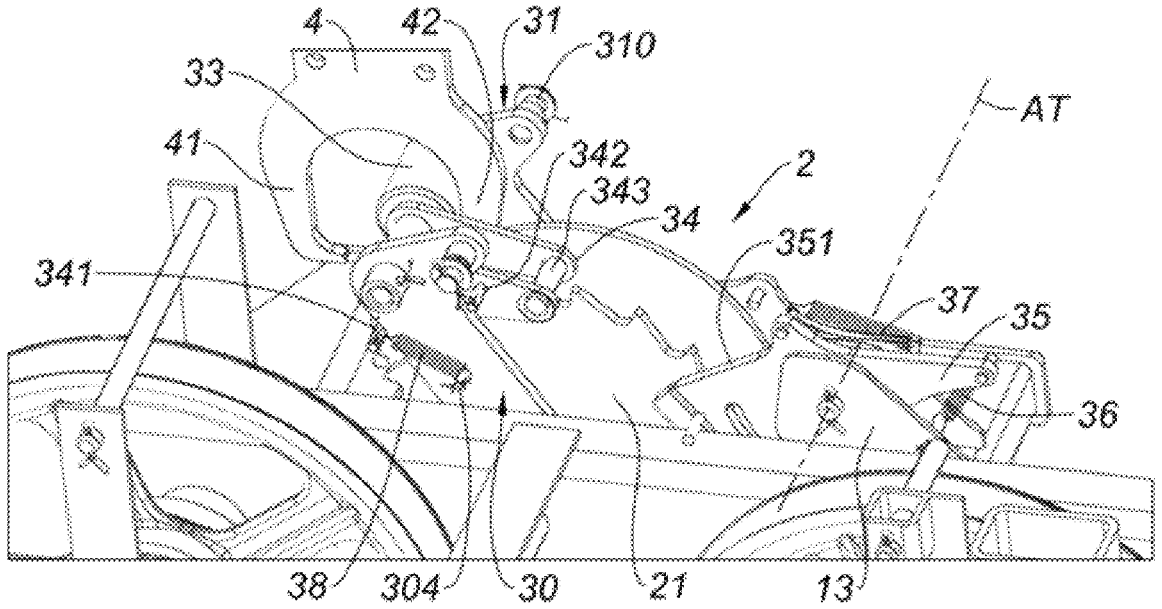

[Fig.5]
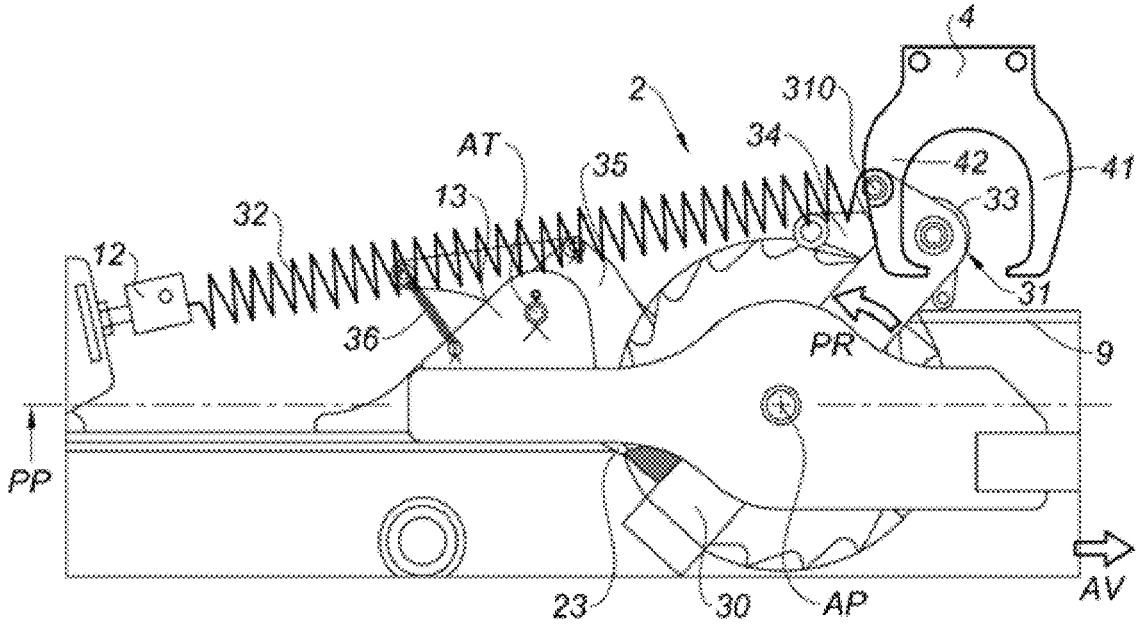
[Fig.6]
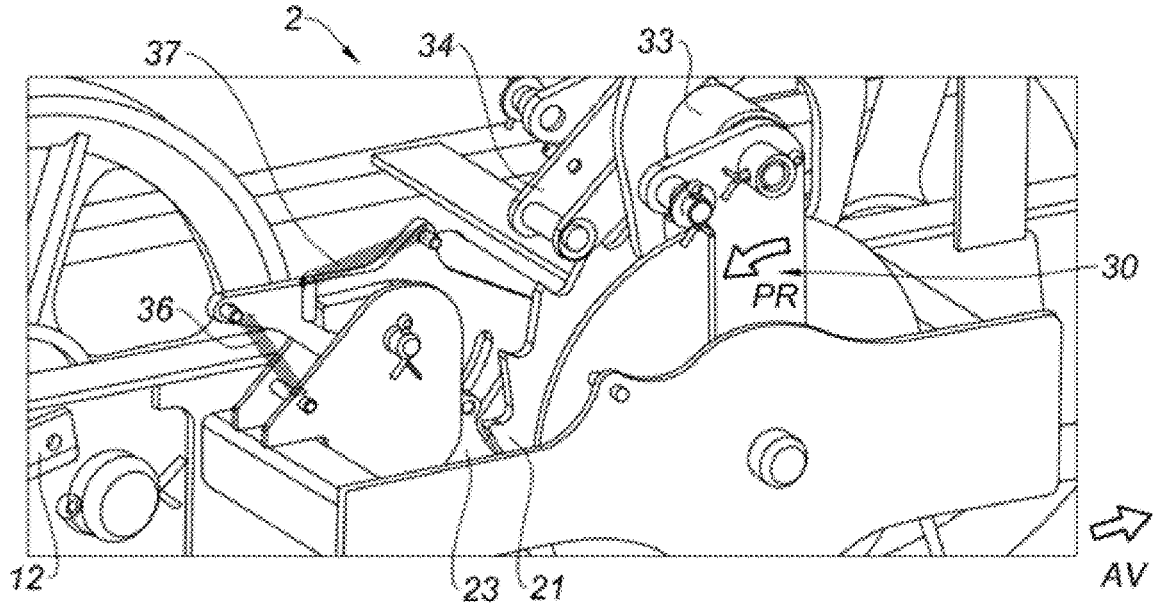

[Fig.7]
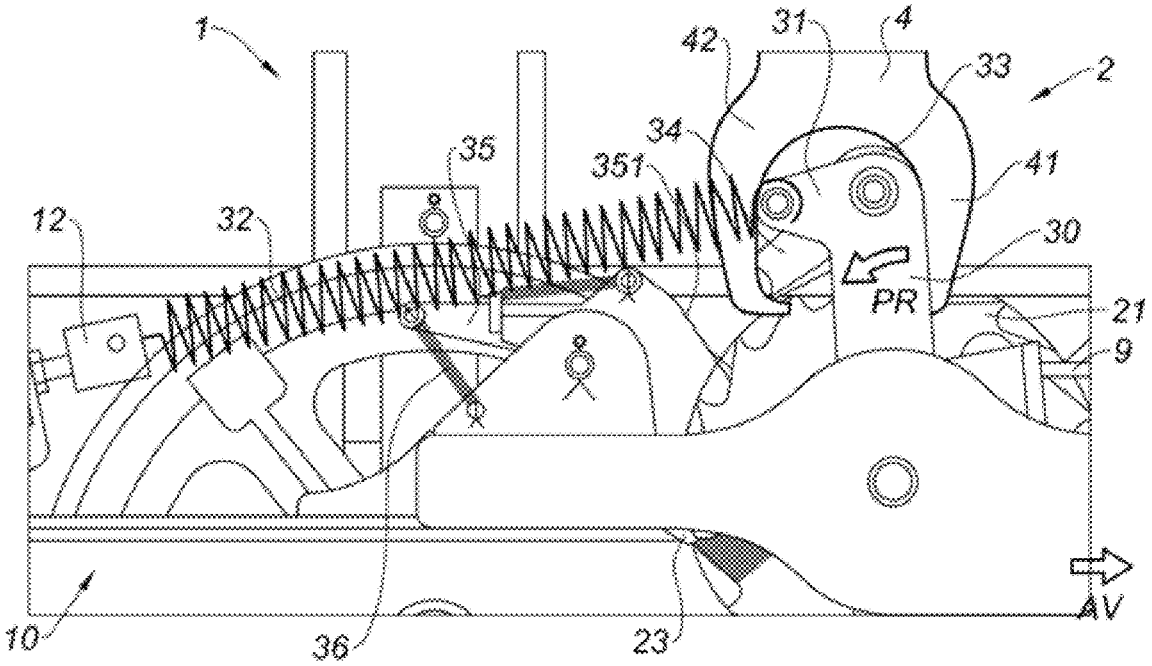
[Fig.8]
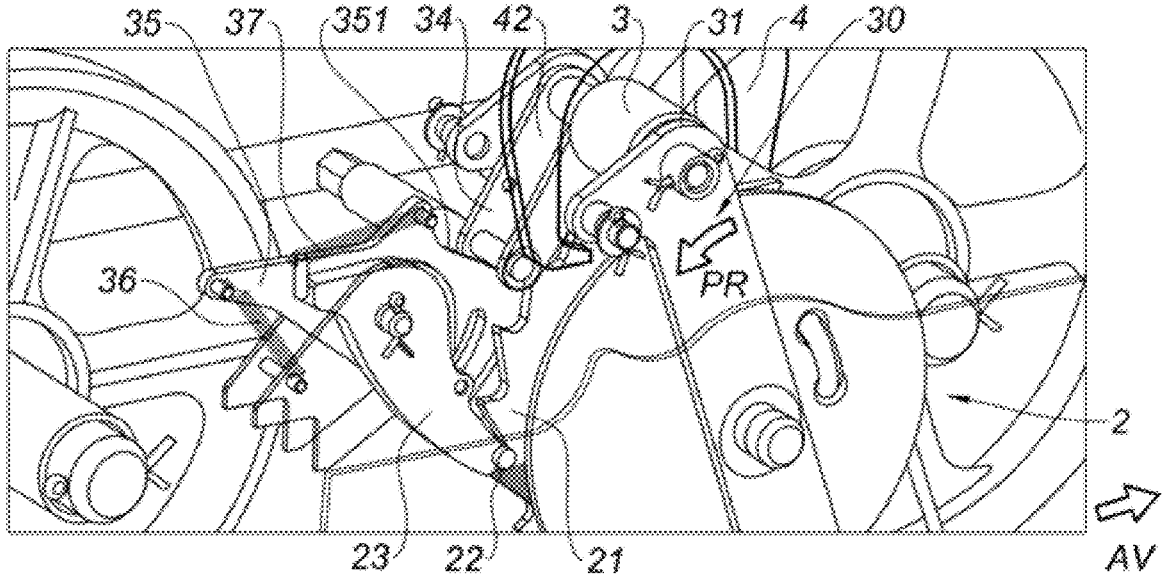

[Fig.9]
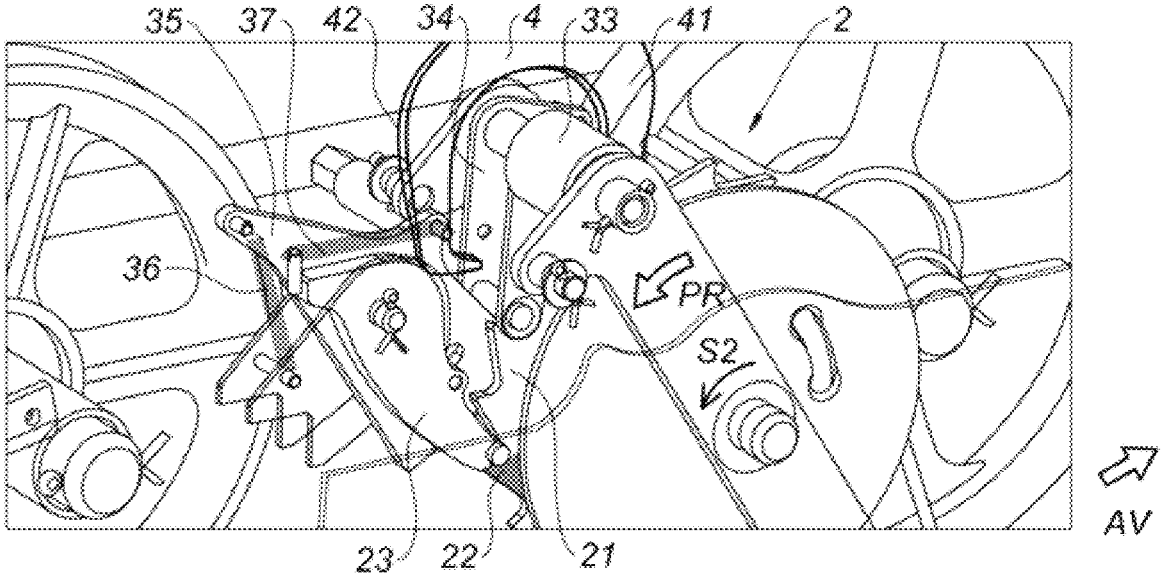
[Fig.10]
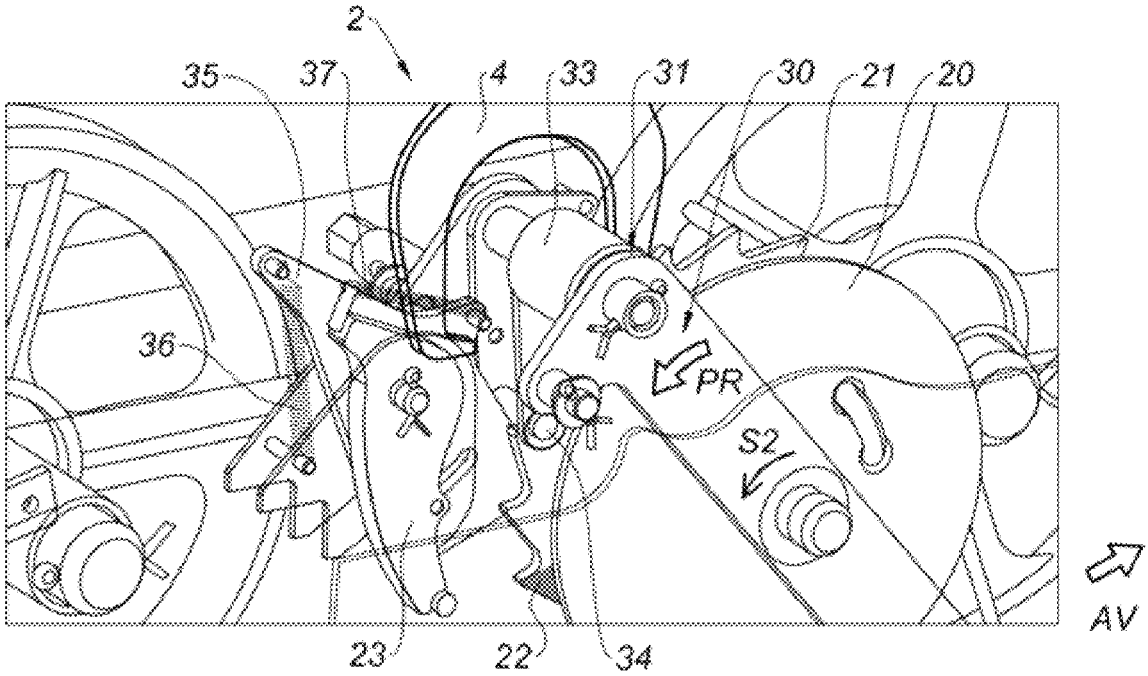

[Fig.11]
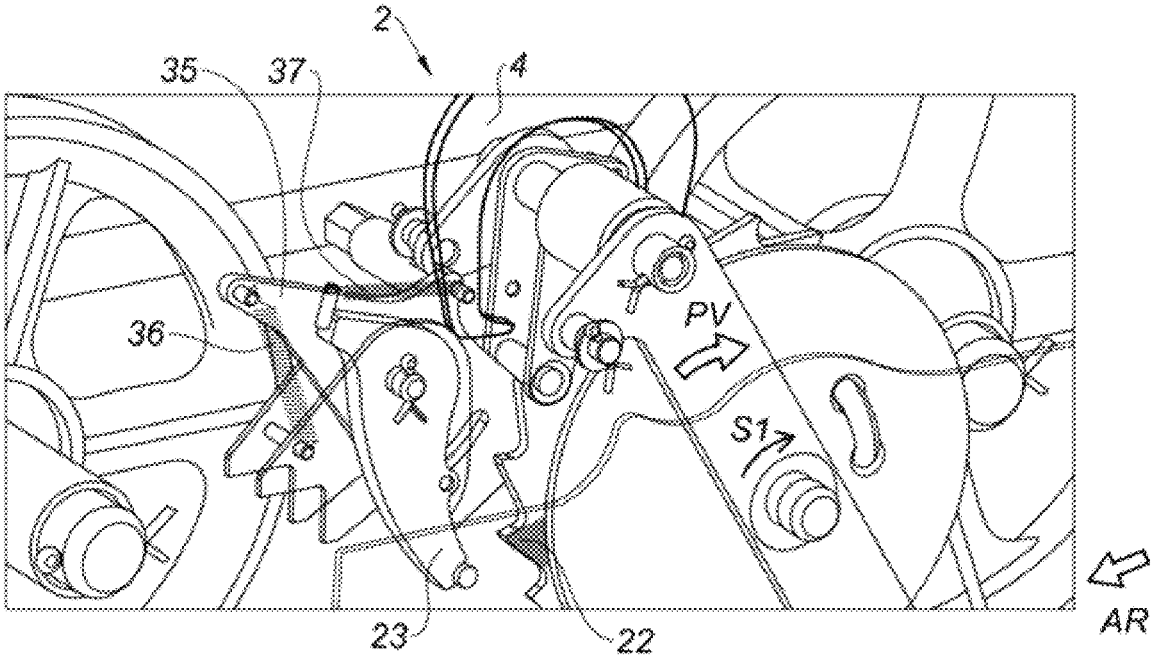

[Fig.12]
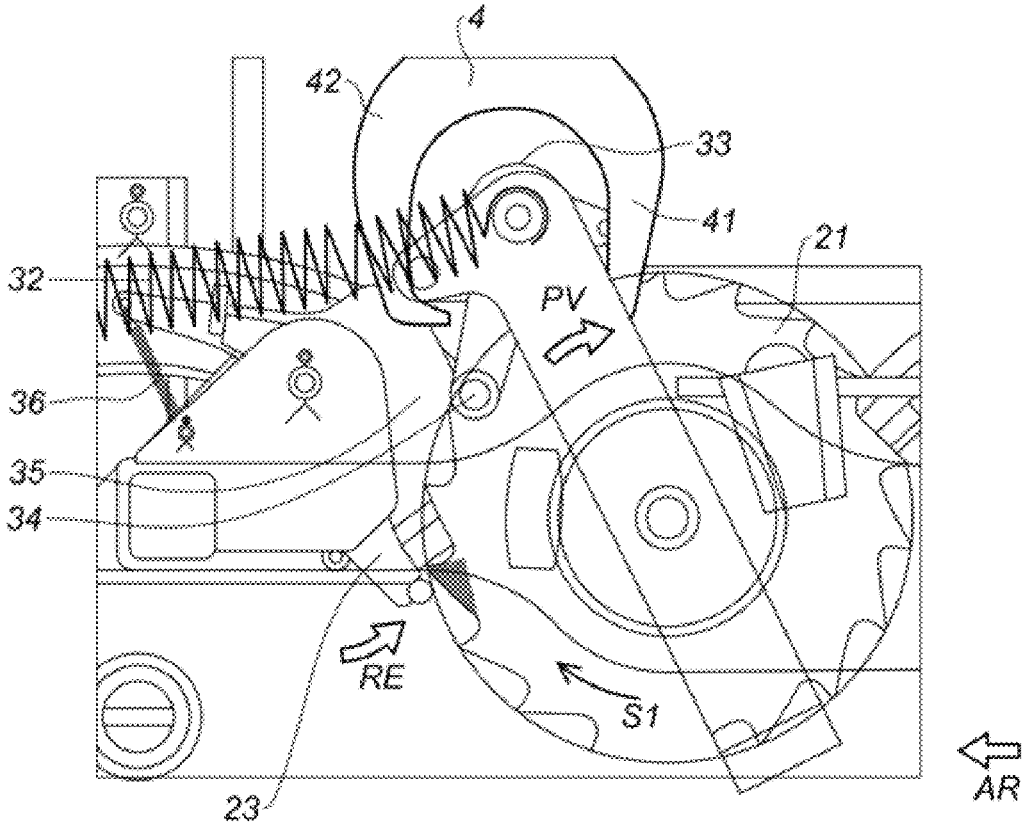
[Fig.13]
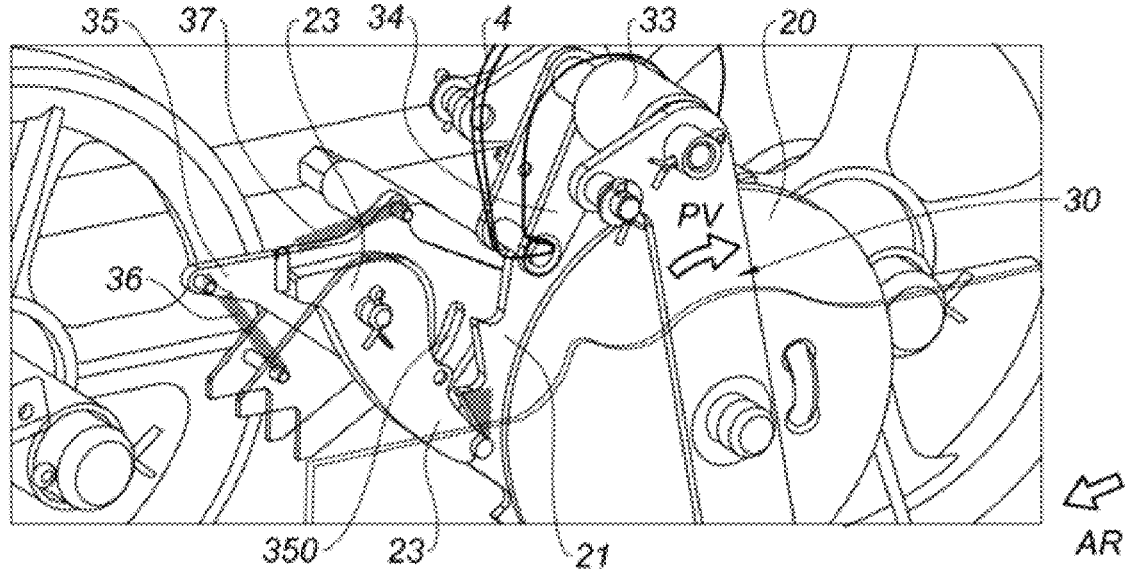

[Fig.14]
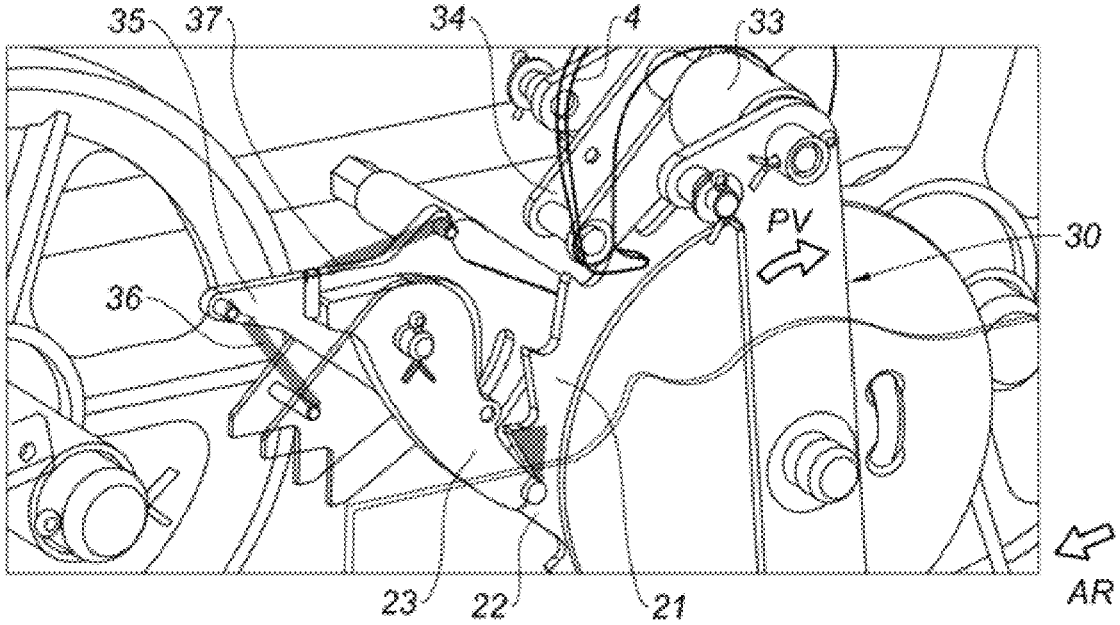

[Fig.15]
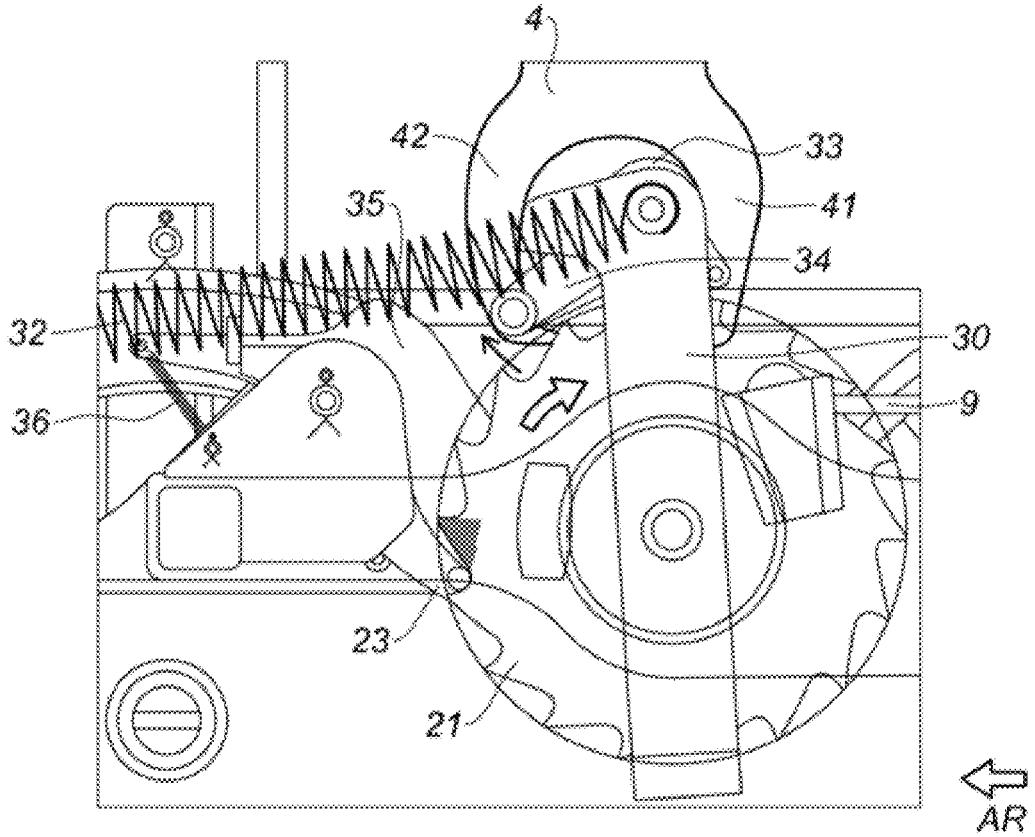
[Fig.16]
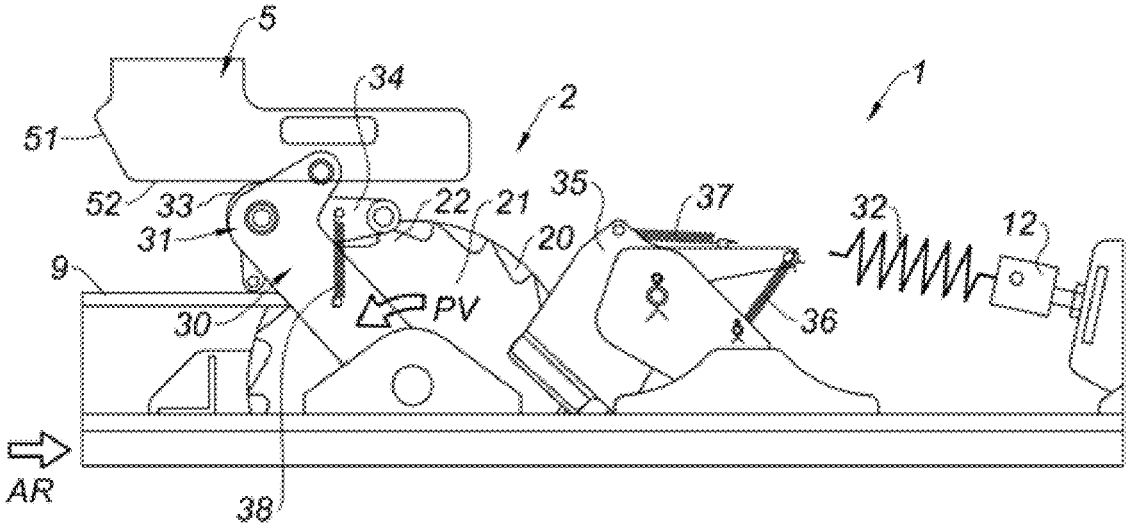

[Fig.17]
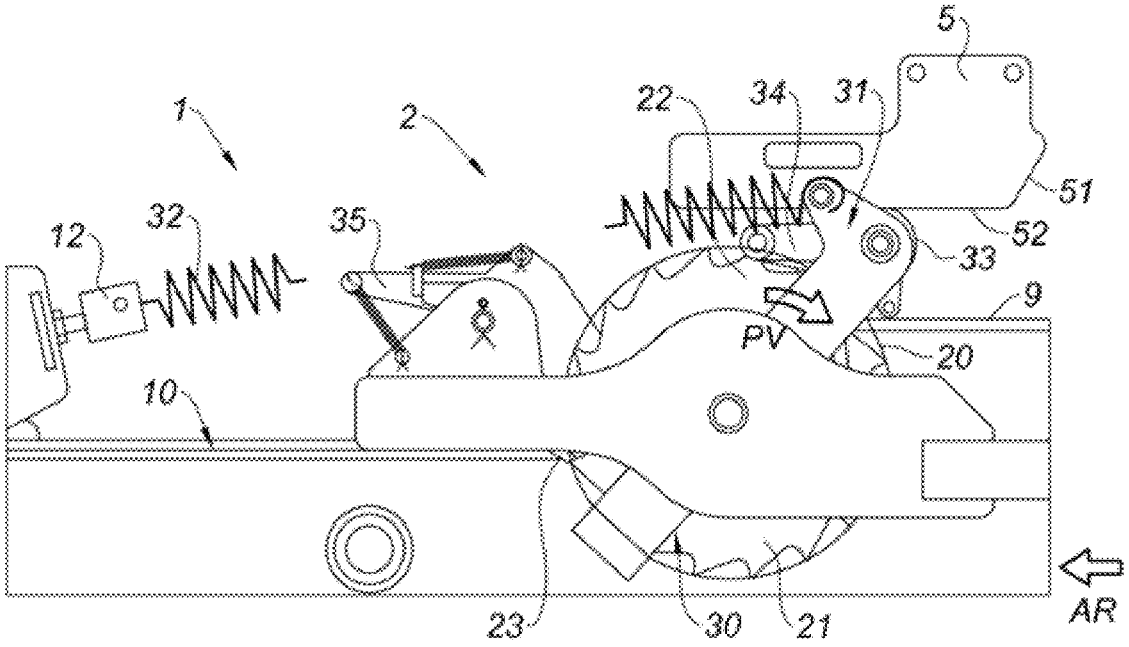

SYSTEM AND METHOD FOR REMOTE SETTING OF A TENSION IN A CRANE TRANSFER CABLE

FIELD OF THE INVENTION

The invention relates to a tension setting system for a remote setting of a tension in a transfer cable ensuring a displacement of a transfer carriage displaceable along a transfer jib of a crane.

It also relates to a crane, such as a tower crane, comprising such a tension setting system, as well as an associated tension setting method.

BACKGROUND

In the field of cranes, it is known to use a tension setting system comprising a transfer winch equipped with a transfer motor and cooperating with the transfer cable to ensure a displacement of the transfer carriage, and a setting mechanical device mounted on the transfer carriage and coupled to the transfer cable to ensure a setting of the tension of the transfer cable, where this setting mechanical device comprises a main drum rotatably mounted on the transfer carriage and around which the transfer cable is partially wound so that, on the one hand, a rotation of the main drum according to the first direction results in an unwinding of the transfer cable translating in a release of the tension in the transfer cable and that, on the other hand, a rotation of the main drum according to the second direction, opposite to the first direction, results in a winding of the transfer cable translating in an increase of the tension in the transfer cable. It is also known to use a blocking system provided with a ratchet wheel secured in rotation with the drum and a pivotally mounted pawl adapted to be blocked in the notches of the ratchet wheel so as to prevent the rotation of the main drum according to the first direction, while enabling the rotation of the main drum according to the second direction.

The transfer cable generally has a large length, which may exceed one hundred meters depending on the lengths of the jib, which helps ensuring that the transfer cable extends during the use thereof, so that it is necessary to re-tension this transfer cable on a regular basis. In general, it is necessary to perform this re-tensioning of the transfer cable about two to three times during the first month of use of the crane, and afterwards about once per quarter.

Indeed, this tensioning of the transfer cable is necessary to ensure a proper operation of the translation of the transfer carriage which does not permit having a loose transfer cable, because a cable looseness safety system would come into action and would block the carriage in a safety position in accordance with conventional safety requirements, an in particular the indications of the European standard EN 14439 entitled «Cranes—Safety—Tower cranes».

This tensioning of the transfer cable is also necessary to guarantee a reactive operation of the translation of the transfer carriage and an accurate positioning of the transfer carriage on the jib. Indeed, at each displacement impulse, the transfer carriage reacts more rapidly when the transfer cable is tensioned enough because there would be no or almost no cable looseness to compensate for.

Conventionally, this tensioning operation (or re-tensioning operation) consists in making the main drum of the setting mechanical device rotate according to the second direction of rotation, the pawl of the blocking system then switching from one notch into another as tensioning is carried out. In order to make the main drum of the setting mechanical device rotate, it is nowadays necessary to manually do it by means of a specific maneuvering key handled by an operator placed on the jib. Such a maneuvering key is generally quite long, for example between 70 and 120 centimeters, so that the operator could exert a sufficient force to re-tension the transfer cable. This operation of tensioning the transfer cable constitutes a dangerous maneuver to perform at a height on the jib of the crane and adds an additional cost for operating the crane.

Moreover, when dismounting the crane, it is necessary to loosen the transfer cable. Conventionally, this detent operation consists in making the main drum of the setting mechanical device rotate according to the first direction of rotation, after having disengaged the pawl from the ratchet wheel. In order to perform this detent operation, it is nowadays necessary to manually do it by means of the same maneuvering key, by making the main drum rotate slightly by means of this maneuvering key according to the second direction of rotation to clear the pawl from its notch, and then by completely disengaging the pawl either by hands or by means of a clamp, while holding the main drum immobile by holding of the maneuvering key, and then finally by releasing the maneuvering key, yet without releasing it, to keep the main drum free to rotate according to the first direction of rotation by the effect of the intrinsic tension in the transfer cable. This operation of loosening the transfer cable also constitutes a dangerous maneuver to perform at a height on the jib of the crane and also adds an additional cost for operating the crane.

SUMMARY

The present invention aims at solving all or part of the aforementioned drawbacks, by providing a system for setting the tension of a transfer cable which enables remote operation of a detent of the transfer cable, and therefore without requiring any manual intervention during the operation where forces are in action, thereby contributing to improving safety during dismount of the crane.

Another object of the invention is to provide a solution which allows automating the detent operation, either in an autonomous manner or through direct piloting by the operator of the crane.

Another object of the invention is to provide a tension setting system which also enables remote operation of a tensioning of the transfer cable, and therefore again without requiring any manual intervention during the operation where forces are in action.

Another object of the invention is to keep, during a remote tensioning operation, the tension within a predefined range of tension values, in order to guarantee a controlled tension and avoid resorting to a free judgment of an operator.

Also, the invention provides a tension setting system for a remote setting of a tension in a transfer cable ensuring a displacement of a transfer carriage displaceable along a transfer jib of a crane, said tension setting system comprising:

a transfer winch equipped with a transfer motor and cooperating with the transfer cable so as to ensure a displacement of the transfer carriage in a forward direction and in a backward direction;

a pilot unit connected to the transfer motor to remotely pilot a displacement of the transfer carriage in the forward direction and in the backward direction; and a setting mechanical device mounted on the transfer carriage and adapted to be actuated by the action of a displacement of the transfer carriage, said setting mechanical device being coupled to the transfer cable and configurable between:

a working configuration in which the setting mechanical device stands still irrespective of the displacement of the transfer carriage and results in a holding of the tension in the transfer cable; and a detent configuration in which, by the action of a displacement of the transfer carriage piloted by the pilot unit according to a predefined first sequence of reciprocating displacement between the forward direction and the backward direction, the setting mechanical device results in a release of the tension in the transfer cable.

Hence, the invention provides for a remote control of the displacement of the transfer carriage, and it is this displacement which will act on the setting mechanical device to cooperate with the transfer cable and result in a release of the tension in the transfer cable, in other words a detent. Thus, and as will described later on, when the setting mechanical device is in the detent configuration, such a tension setting system allows loosening, remotely, and possibly in an automated manner, the transfer cable by displacing the transfer carriage which is brought to act on this setting mechanical device.

In a particular embodiment, the setting mechanical device can also be configured in a tensioned configuration in which, by the action of a displacement of the transfer carriage piloted by the pilot unit according to a predefined second sequence of reciprocating displacement between the forward direction and the backward direction, the setting mechanical device results in an increase of the tension in the transfer cable.

Thus, this embodiment still provides for a remote control of the displacement of the transfer carriage, but this time this displacement will act on the setting mechanical device to cooperate with the transfer cable and result in an increase of the tension in the transfer cable, in other words a tensioning. Thus, in this embodiment, when the setting mechanical device is in the tensioned configuration, the tension setting system allows tensioning, remotely, and possibly in an automated manner, the transfer cable by displacing the transfer carriage which is brought to act on this setting mechanical device.

In sum, this tension setting system is automated in order to facilitate the implementation by the crane operator, guarantee proper maneuvers and the accuracy thereof, and allow having a controlled repeatability of the sequences and of the detent and tensioning forces imparted on the transfer cable (s).

This embodiment also allows automatically ensuring an update of the «zero range» of the transfer carriage which corresponds to the reference position of the transfer carriage to determine its position along the jib, after tensioning again.

According to one feature, the pilot unit comprises an autopilot module configured to automatically implement the first sequence of displacement once the setting mechanical device is in the detent configuration in order to automatically implement a release of the tension in the transfer cable.

Thus, with this autopilot module, the detent operation is performed in an automated manner, without any human action during the operation, the autopilot module following a dedicated pilot program which may implement several successive second sequences of displacement in order to loosen incrementally.

According to one possibility, the autopilot module is configured to automatically implement the second sequence of displacement once the setting mechanical device is in the tensioned configuration in order to automatically implement an increase of the tension in the transfer cable.

Thus, with this autopilot module, the tensioning operation is performed in an automated manner, without any human action during the operation, the autopilot module following a dedicated pilot program which may implement several successive second sequences of displacement in order to tension again incrementally.

According to another possibility, the setting mechanical device comprises a safety device connected to the pilot unit and switchable between an operating configuration preventing the first sequence of displacement and enabling the second sequence of displacement, and a mounting configuration enabling both the first sequence of reciprocating displacement and the second sequence of displacement.

Thus, the setting mechanical device is secured through an intervention on the safety device so as to switch from a tensioning operation into a detent operation and vice versa, the tensioning being preferably accessible to the assembler of the crane and to the operator of the crane (the tensioning being necessary during mounting of the crane and in operation once mounted), whereas the detent is accessible only to the assembler of the crane (the detent being necessary only during dismount of the crane).

According to another possibility, the setting mechanical device comprises a main mechanism coupled to the transfer cable and actuatable in a first direction for a release of the tension in the transfer cable and in a second direction for an increase of the tension in the transfer cable, this main mechanism being configurable between a locked configuration adapted to prevent an actuation in the first direction and to enable an actuation in the second direction, and an unlocked configuration adapted to enable an actuation in the second direction by the effect of the tension in the transfer cable, and wherein the setting mechanical device further comprises a secondary mechanism cooperating with the main mechanism by the action of a displacement of the transfer carriage piloted by the pilot unit, either to actuate said main mechanism in the first direction for a release of the tension in the transfer cable after an unlocking of the main mechanism by said secondary mechanism;

or to actuate said main mechanism in the second direction for an increase of the tension in the transfer cable when the setting mechanical device is in the tensioned configuration.

In a particular embodiment, the secondary mechanism is configurable between:

the detent configuration in which, by the action of a displacement of the transfer carriage piloted by the pilot unit according to the first sequence of displacement, the secondary mechanism is adapted to act on the main mechanism to make it pass from a locked configuration into an unlocked configuration and to enable an actuation of the main mechanism in the first direction for a release of the tension in the transfer cable until a return in the locked configuration;

the tensioned configuration in which, by the effect of a displacement of the transfer carriage piloted by the pilot unit according to the second sequence of displacement, the secondary mechanism is adapted to actuate the main mechanism in the second direction for an increase of the tension in the transfer cable.

According to one possibility, the main mechanism comprises a main drum rotatably mounted according to a main axis and around which the transfer cable is partially wound so that, on the one hand, a rotation of the main drum according to the first direction causes an unwinding of the transfer cable translating in a release of the tension in the transfer cable and, on the other hand, a rotation of the main drum according to the second direction, opposite to the first direction, results in a winding of the transfer cable translating in an increase of the tension in the transfer cable;

and wherein the main mechanism further comprises a main blocking system displaceable between:

- the locked configuration in which the main blocking system is engaged with the main drum to prevent the rotation of the main drum in the first direction and enable the rotation of the main drum in the second direction; and
- the unlocked configuration in which the main blocking system is cleared from the main drum to enable the rotation of the main drum in the first direction.

According to one variant, this transfer cable has:

- a front strand provided with a first end fastened and wound on the main drum and an opposite second end fastened on a first side of the transfer drum of the transfer winch rotatably driven by the transfer motor, where this front strand passes through at least one front transmission pulley disposed at the tip of the transfer jib; and
- a rear strand provided with a first end fastened on the transfer carriage and an opposite second end fastened on a second side of the transfer drum, this rear strand passing through at least one rear transmission pulley disposed at the root of the transfer jib.

According to one feature, the main blocking system comprises:

- a ratchet wheel secured in rotation with the main drum and provided at the periphery thereof with a series of notches of the unidirectional notch type;
- a main pawl pivotally mounted and adapted to be blocked in the notches of the ratchet wheel to prevent the rotation of the main drum according to the first direction, while enabling the rotation of the main drum according to the second direction; and
- a main biasing means urging the main pawl towards a blocking position in the notches of the ratchet wheel.

According to another feature, the secondary mechanism comprises:

- a secondary lever pivotally mounted about the main axis and provided with a head projecting beyond the ratchet wheel, and said secondary lever being coupled to a rear biasing means which urges the secondary lever backwards;
- a secondary guide means mounted on the head;
- a secondary pawl pivotally mounted on the head of the secondary lever and adapted to come into engagement with the notches of the ratchet wheel to act in rotation on this ratchet wheel;
- a secondary cam pivotally mounted and having a cam surface, said secondary cam being coupled to the main pawl via a coupling means, and said secondary cam being coupled to a cam biasing means which urges the secondary cam towards a neutral position;
- a secondary biasing means mounted between the secondary lever and the secondary pawl, said secondary biasing means being configurable between:
- a first configuration associated to the detent configuration of the setting mechanical device, in which the secondary biasing means urges the secondary pawl towards disengagement from the ratchet wheel; and
- a second configuration associated to the tensioned configuration of the setting mechanical device, in which the secondary biasing means urges the secondary pawl towards engagement in the notches of the ratchet wheel.

Advantageously, the secondary mechanism comprises a means for adjusting the biasing force exerted by the rear biasing means on the secondary lever.

Indeed, such an adjustment means enables adjustment of the biasing force on the secondary lever, and therefore the push force of the secondary lever on the ratchet wheel to make the main drum rotate according to the second direction of rotation (tensioning direction).

In a particular embodiment, in the detent configuration of the setting mechanical device, the tension setting system further comprises a first stop element which is static with respect to the transfer carriage and which is shaped so as to cooperate with the setting mechanical device by the action of a displacement of the transfer carriage according to the first sequence of displacement.

Thus, the displacement of the transfer carriage necessarily imposes a displacement of the setting mechanical device which is mounted on the transfer carriage, so that in the detent operation and by displacing this transfer carriage according to the first sequence, the setting mechanical device will cooperate with the static first stop element so as to act on the transfer cable and result in the release of the tension in the transfer cable.

According to one possibility, the first stop element has a front end and a rear stop which extend opposite to one another so as to surround the secondary guide means.

According to one variant, the first stop element has an inverted «U» like general shape.

According to another possibility, starting from a start situation in which the main pawl is engaged in a start main notch of the ratchet wheel and the secondary lever is tilted forwards, against the rear biasing means, by means of a bearing of the secondary guide means on the rear stop of the first stop element, the setting mechanical device is adapted to allow for a release of the tension in the transfer cable by the action of a displacement of the transfer carriage according to the first sequence of displacement, as follows:

(1-a) a displacement of the transfer carriage in the forward direction is adapted to result in the following successive phases:

- the secondary lever pivots backwards, by the effect of the rear biasing means, until the secondary pawl, which is in disengagement from the ratchet wheel, bears on the cam surface of the secondary cam, said secondary cam being in the neutral position; then
- the rear stop of the first stop element separates from the secondary guide means and the front stop then bears on the secondary guide means, which makes the secondary lever pivot backwards again, concomitantly with a pivoting of the secondary pawl in the direction of the ratchet wheel, said secondary pawl being guided on the cam surface of the secondary cam, until the secondary pawl bears against the ratchet wheel before being engaged and blocked at the bottom of a secondary notch of the ratchet wheel;
- the secondary lever stops pivoting backwards, resulting in a push of the secondary pawl into the secondary notch which makes the ratchet wheel rotate according to the second direction, thereby releasing the main pawl from the start main notch in which it is engaged, and the bearing of the secondary pawl on the secondary cam results in the pivoting of the secondary cam according to an opening direction against the cam biasing means, and by rotating, this secondary cam makes the main pawl pivot, via the coupling means, so that the main pawl released beforehand moves away from the ratchet wheel until the main blocking system is in the unlocked configuration;

and afterwards (1-b) a displacement of the transfer carriage in the backward direction is adapted to result in the following successive phases:

the main drum and the ratchet wheel pivot in the first direction by the effect of a force exerted by the transfer cable on the main drum, causing the pivoting of the secondary lever forwards, the rear biasing means not resisting this forward pivoting of the secondary lever and the secondary guide means remaining in contact with the front stop of the first stop element; and concomitantly with the backward pivoting of the secondary lever, the secondary cam pivots according to a closure direction, opposite to the opening direction, by the effect of the cam biasing means, which lets the main pawl return into contact with the ratchet wheel by the effect of the main biasing means, until said main pawl is engaged with an end main notch located after the start main notch according to the first direction, for a release of the tension in the transfer cable; then the front stop of the first stop element separates from the secondary guide means and the rear stop of the first stop element then bears on the secondary guide means, which makes the secondary lever pivot backwards again until the secondary pawl disengages from the ratchet wheel by the effect of the secondary biasing means for a return into a start situation.

According to another possibility, the first stop element is removably fastened on the transfer jib, in particular at the jib root, in order to enable mounting the first stop element in the detent configuration and enable removing the first stop element in the working configuration.

Thus, before proceeding with a detent operation, this first stop element should be fixed, after having positioned the transfer carriage beforehand, and afterwards the entire detent operation is performed in a remote manner as previously described.

In a particular embodiment, in the tensioned configuration of the setting mechanical device, the tension setting system further comprises a second stop element which is static with respect to the transfer carriage and which is shaped so as to cooperate with the setting mechanical device by the action of a displacement of the transfer carriage according to the second sequence of displacement.

Thus, in the tensioning operation and by displacing the transfer carriage according to the second sequence, the setting mechanical device will cooperate with the static second stop element so as to act on the transfer cable and result in the increase of the tension in the transfer cable.

According to one possibility, the second stop element has an inclined front face forming a ramp, extended by a longitudinal lower face.

According to another possibility, the main pawl is engaged in a start main notch of the ratchet wheel, the setting mechanical device is adapted to allow for an increase of the tension in the transfer cable by the action of a displacement of the transfer carriage according to a the second sequence of displacement, as follows:

(2-a) a displacement of the transfer carriage in the backward direction is adapted to result in the following successive phases:

the secondary guide means bears on the inclined front face of the second stop element, making the secondary lever pivot forwards, against the rear biasing means, until the secondary guide means bears on the longitudinal lower face of the second stop element;

the forward pivoting of the secondary lever urges the secondary pawl, which is biased against the ratchet wheel by the secondary biasing means, to leave a start secondary notch so as to pass into an end secondary notch located before the start secondary notch according to the first direction;

and afterwards ( 2-b) a displacement of the transfer carriage in the forward direction is adapted to result in the following successive phases:

the secondary guide means separates from the longitudinal lower face of the second stop element, and bears on the inclined front face of the second stop element, enabling the secondary lever to pivot backwards by the effect of the rear biasing means;

the backward pivoting of the secondary lever urges the secondary pawl to exert a push in the bottom of the end secondary notch, causing a rotation of the ratchet wheel and of the main drum according to the second direction, and the main pawl leaves the start main notch so as to pass into an end main notch located before the start main notch according to the first direction, for an increase of the tension in the transfer cable.

Advantageously, the second stop element is removably fastened on the transfer jib, in particular at the jib root, in order to enable mounting said second stop element in the tensioned configuration and enable removing said second stop element in the working configuration and in the detent configuration.

Thus, before proceeding with a tensioning operation, this second stop element should be fixed, after having positioned the transfer carriage beforehand, and afterwards the entire tensioning operation is performed in a remote manner as previously described.

In a particular embodiment, the first stop element and the second stop element are mounted at the same location on the transfer jib respectively in the detent configuration and in the tensioned configuration.

Advantageously, the tension setting system further comprises at least one sensor for measuring at least one of the following parameters: tension in the transfer cable, configuration of the setting mechanical device, position of the transfer carriage, position of a constitutive member of the setting mechanical device.

One or more of these sensors will allow making an automation of the detent operation and/or the tensioning operation safe and reliable.

The invention also relates to a crane provided with a transfer carriage displaceable along a transfer jib by means of a transfer cable, such a crane comprising a tension setting system according to the invention.

The invention also concerns a tension setting method for a remote setting of a tension in a transfer cable ensuring a displacement of a transfer carriage displaceable along a transfer jib of a crane as described hereinabove, such a tension setting method implementing a detent operation for a release of the tension in the transfer cable and comprising:

a configuration of the setting mechanical device in the detent configuration, followed by a piloting by the pilot unit of the displacement of the transfer carriage according to the first sequence of displacement to act on the setting mechanical device and result in a release of the tension in the transfer cable.

According to one possibility, during the detent operation, the piloting by the pilot unit of the displacement of the transfer carriage according to the first sequence of displacement is automatically implemented by the previously described autopilot module.

According to one possibility, during the detent operation, the piloting by the pilot unit of the displacement of the transfer carriage according to the first sequence of displacement implements several successive first sequences of displacement until the tension in the transfer cable falls below a predefined low threshold.

According to one possibility, during the detent operation, there is provided for a check-up of the configuration of the setting mechanical device in the detent configuration, before starting the piloting by the pilot unit of the displacement of the transfer carriage according to the first sequence of displacement.

Advantageously, the check-up of the configuration of the setting mechanical device in the detent configuration is carried out by means of at least one sensor.

According to one possibility, the tension setting method implements the piloting by the pilot unit of the displacement of the transfer carriage according to the first sequence of displacement as follows:

(1-a) a displacement of the transfer carriage in the forward direction results in the following successive phases:

the secondary lever pivots backwards, by the effect of the rear biasing means, until the secondary pawl, which is in disengagement from the ratchet wheel, bears on the cam surface of the secondary cam, said secondary cam being in the neutral position; then the rear stop of the first stop element separates from the secondary guide means and the front stop then bears on the secondary guide means, which makes the secondary lever pivot backwards again, concomitantly with a pivoting of the secondary pawl in the direction of the ratchet wheel, said secondary pawl being guided on the cam surface of the secondary cam, until the secondary pawl bears against the ratchet wheel before being engaged and blocked at the bottom of a secondary notch of the ratchet wheel;

the secondary lever stops pivoting backwards, resulting in a push of the secondary pawl into the secondary notch which makes the ratchet wheel rotate according to the second direction, thereby releasing the main pawl from the start main notch in which it is engaged, and the bearing of the secondary pawl on the secondary cam results in the pivoting of the secondary cam according to an opening direction against the cam biasing means, and by rotating, this secondary cam makes the main pawl pivot, via the coupling means, so that the main pawl released beforehand moves away from the ratchet wheel until the main blocking system is in the unlocked configuration;

and afterwards (1-b) a displacement of the transfer carriage in the backward direction results in the following successive phases:

the main drum and the ratchet wheel pivot in the first direction by the effect of a force exerted by the transfer cable on the main drum, causing the pivoting of the secondary lever forwards, the rear biasing means not resisting this forward pivoting of the secondary lever and the secondary guide means remaining in contact with the front stop of the first stop element; and concomitantly with the backward pivoting of the secondary lever, the secondary cam pivots according to a closure direction, opposite to the opening direction, by the effect of the cam biasing means, which lets the main pawl return into contact with the ratchet wheel by the effect of the main biasing means, until said main pawl is engaged with an end main notch located after the start main notch according to the first direction, for a release of the tension in the transfer cable; then the front stop of the first stop element separates from the secondary guide means and the rear stop of the first stop element then bears on the secondary guide means, which makes the secondary lever pivot backwards again until the secondary pawl disengages from the ratchet wheel by the effect of the secondary biasing means for a return into a start situation.

In a particular embodiment, the tension setting method implements a tensioning operation for an increase of the tension in the transfer cable and comprising:

a configuration of the setting mechanical device in the tensioned configuration, followed by a piloting by the pilot unit of the displacement of the transfer carriage according to the second sequence of displacement to act on the setting mechanical device and result in an increase of the tension in the transfer cable.

According to one possibility, during the tensioning operation, the piloting by the pilot unit of the displacement of the transfer carriage according to the second sequence of displacement is automatically implemented by the previously described autopilot module.

According to one possibility, during the tensioning operation, the piloting by the pilot unit of the displacement of the transfer carriage according to the second sequence of displacement implements several successive second sequences of displacement until the tension in the transfer cable rises above a predefined high threshold.

According to one possibility, during the tensioning operation, there is provided for a check-up of the configuration of the setting mechanical device in the tensioned configuration, before starting the piloting by the pilot unit of the displacement of the transfer carriage according to the second sequence of displacement.

Advantageously, the check-up of the configuration of the setting mechanical device in the tensioned configuration is carried out by means of at least one sensor.

According to one possibility, the tension setting method implements the piloting by the pilot unit of the displacement of the transfer carriage according to the second sequence of displacement as follows:

(2-a) a displacement of the transfer carriage in the backward direction results in the following successive phases:

the secondary guide means bears on the inclined front face of the second stop element, making the secondary lever pivot forwards, against the rear biasing means, until the secondary guide means bears on the longitudinal lower face of the second stop element;

the forward pivoting of the secondary lever urges the secondary pawl, which is biased against the ratchet wheel by the secondary biasing means, to leave a start secondary notch so as to pass into an end secondary notch located before the start secondary notch according to the first direction;

and afterwards (2-b) a displacement of the transfer carriage in the forward direction results in the following successive phases:

the secondary guide means separates from the longitudinal lower face of the second stop element, and bears on the inclined front face of the second stop element, enabling the secondary lever to pivot backwards by the effect of the rear biasing means;

the backward pivoting of the secondary lever urges the secondary pawl to exert a push in the bottom of the end secondary notch, causing a rotation of the ratchet wheel and of the main drum according to the second direction, and the main pawl leaves the start main notch so as to pass into an end main notch located before the start main notch according to the first direction, for an increase of the tension in the transfer cable.

BRIEF DESCRIPTION OF THE DRAWINGS

Other features and advantages of the present invention will appear on reading the detailed description hereinafter, of a non-limiting example of implementation, made with reference to the appended figures in which:

FIG. 1 is a partial and perspective schematic view, from the exterior side, of a transfer carriage equipped with a setting mechanical device for a crane according to the invention, with a first stop element in place for operating a release of the tension in the transfer cable, in a start situation and with the secondary biasing spring in the second configuration;

FIG. 2 is a partial and perspective schematic view according to another viewpoint, of the transfer carriage still in the start situation and with the secondary biasing spring in the second configuration;

FIG. 3 is a partial and perspective schematic view, from the interior side, of the transfer carriage still in the start situation and with the secondary biasing spring in the second configuration;

FIG. 4 is a partial and perspective schematic view, from the interior side as in FIG. 3, of the transfer carriage still in the start situation but this time with the secondary biasing spring in the first configuration in order to start the first sequence of displacement adapted to operate a release of the tension in the transfer cable;

FIG. 5 is a partial and side schematic view, from the exterior side, of the transfer carriage still in the start situation and with the secondary biasing spring in the first configuration, at the start of the first sequence of displacement;

FIG. 6 is a partial and perspective schematic view, from the exterior side, of the transfer carriage which has performed a displacement in the forward direction in comparison with the start situation of FIG. 6, in the context of the first sequence of displacement;

FIG. 7 is a partial and side schematic view, from the exterior side, of the transfer carriage which has performed a displacement in the forward direction in comparison with the start situation of FIG. 6, in the context of the first sequence of displacement;

FIG. 8 is a partial and perspective schematic view, from the exterior side, of the transfer carriage which has performed a displacement in the forward direction in comparison with the situation of FIGS. 6 and 7, in the context of the first sequence of displacement;

FIG. 9 is a partial and perspective schematic view, from the exterior side, of the transfer carriage which has performed a displacement in the forward direction in comparison with the situation of FIG. 8, in the context of the first sequence of displacement;

FIG. 10 is a partial and perspective schematic view, from the exterior side, of the transfer carriage which has performed a displacement in the forward direction in comparison with the situation of FIG. 9, in the context of the first sequence of displacement;

FIG. 11 is a partial and perspective schematic view, from the exterior side, of the transfer carriage which has performed a displacement in the backward direction in comparison with the situation of FIG. 10, in the context of the first sequence of displacement; and FIG. 12 is a partial and side schematic view, from the exterior side, of the transfer carriage which has performed a displacement in the backward direction in comparison with the situation of FIG. 11, in the context of the first sequence of displacement;

FIG. 13 is a partial and perspective schematic view, from the exterior side, of the transfer carriage which has performed a displacement in the backward direction in comparison with the situation of FIG. 12, in the context of the first sequence of displacement;

FIG. 14 is a partial and perspective schematic view, from the exterior side, of the transfer carriage which has performed a displacement in the backward direction in comparison with the situation of FIG. 13, thereby reaching an end situation of the first sequence of displacement;

FIG. 15 is a partial and side schematic view, from the exterior side, of the transfer carriage which has performed a displacement in the backward direction in comparison with the situation of FIG. 14, thereby reaching the end situation of the first sequence of displacement;

FIG. 16 is a partial and side schematic view, from the interior side, of the transfer carriage with a second stop element in place to operate an increase of the tension in the transfer cable, and with the secondary biasing spring in the second configuration; and FIG. 17 is a partial and side schematic view, from the exterior side, of the transfer carriage with the second stop element in place and with the secondary biasing spring in the second configuration.

DETAILED DESCRIPTION

The figures illustrate a transfer carriage 1 intended to be displaceable along a transfer jib of a crane, and in particular a tower crane. Thus, this crane comprises a transfer jib along which the transfer carriage 1 can be displaced, where the transfer jib is mounted on a tower at the jib root. The transfer carriage 1 is shaped so as to transfer a load along the transfer jib.

The transfer carriage 1 circulates on a roller track between the root of the jib and the tip of the jib (or free end of the transfer jib), and supports at least two wheels 14 intended to roll on the roller track of the transfer jib. This transfer carriage 1 also supports a hoist member (such as a hook) mounted on a hoist block hanging from the transfer carriage 1 by a hoist cable. The transfer carriage 1 can be displaced forwards (in other words in the direction of the tip of the jib), and also backwards (in other words in the direction of the root of the jib).

In order to ensure the displacement of the transfer carriage 1, the crane comprises a transfer winch (not illustrated) mounted on the transfer jib, at the jib root, equipped with a transfer motor driving in rotation a transfer drum cooperating with a transfer cable 9 so as to ensure a displacement of the transfer carriage 1 in a forward direction and in a backward direction.

The crane also comprises a pilot unit (not illustrated) connected to the transfer motor to remotely pilot a displacement of the transfer carriage in the forward direction and in the backward direction, in particular for a piloting by the crane operator placed in a cabin disposed at the jib root.

The crane also comprises a setting mechanical device 2 mounted on the transfer carriage 1 and adapted to be actuated by the action of a displacement of the transfer carriage 1 so as to enable a remote setting by the crane operator of the tension of the transfer cable 9 through displacements of the transfer carriage 1 forwards and backwards.

This setting mechanical device 2, associated to the transfer winch and to the pilot unit, together form a tension setting system for a remote setting of the tension in the transfer cable 10.

The setting mechanical device 2 comprises a main mechanism coupled to the transfer cable 9 and actuatable in a first direction for a release of the tension in the transfer cable 9 and in a second direction for an increase of the tension in the transfer cable 9.

For this purpose, this main mechanism comprises a main drum 20 rotatably mounted according to a main axis AP on a frame 11 of the transfer carriage 1 and around which the transfer cable 9 is partially wound.

More specifically, this transfer cable 9 has:

- a front strand provided with a first end fastened and wound on the main drum 20 and an opposite second end fastened on a first side of the transfer drum of the transfer winch, where this front strand passes through at least one front transmission pulley disposed at the tip of the transfer jib; and
- a rear strand provided with a first end fastened on the transfer carriage 1, at a fixed point of its frame 10, and an opposite second end fastened on a second side of the transfer drum, this rear strand passing through at least one rear transmission pulley disposed at the root of the transfer jib.

Thus, the front strand has a length substantially equivalent to twice the length of the transfer jib, whereas the rear strand has a length substantially equivalent to the length of the transfer jib. For a forward displacement of the transfer carriage 1, the transfer motor makes the transfer drum rotate according to a direction of rotation called forward direction which corresponds to a winding of the front strand on the transfer drum and to an unwinding of the rear strand on the transfer drum. For a backward displacement of the transfer carriage 1, the transfer motor makes the transfer drum rotate according to a direction of rotation called backward direction, opposite to the forward direction, which corresponds to an unwinding of the front strand on the transfer drum and to a winding of the rear strand on the transfer drum.

The front strand of the transfer cable 9 being fastened and wound on the main drum 20, it is possible to set the tension of the transfer cable 9 by making the main drum 20 rotate, with:

- a rotation of the main drum 20 according to a first direction (clockwise direction in FIGS. 5, 7, 12, 15) which results in an unwinding of the front strand of the transfer cable 9 translating in a release of the tension in the transfer cable 9;
- a rotation of the main drum 20 according to a second direction (anticlockwise direction in FIGS. 5, 7, 12, 15), opposite to the first direction, which results in a winding of the front strand of the transfer cable 9 translating to an increase of the tension in the transfer cable 9.

This main drum 20 of the main mechanism can be configured between:

- a locked configuration adapted to prevent an actuation in the first direction and to enable an actuation in the second direction, in other words preventing a release of the tension in the transfer cable 9; and
- an unlocked configuration adapted to enable an actuation in the second direction by the effect of the tension in the transfer cable 9, in other words enabling a release of the tension in the transfer cable 9.

For this purpose, the main mechanism of the setting mechanical device 2 further comprises a main blocking system which comprises:

- a ratchet wheel 21 secured in rotation with the main drum 20 according to the main axis AP, where this ratchet wheel 21 is provided at the periphery thereof with a series of notches 22 of the unidirectional notch type;
- a main pawl 23 pivotally mounted on the frame 10 according to a transverse axis AT parallel to the main axis AP and adapted to be blocked in the notches 22 of the ratchet wheel 21 to prevent the rotation of the main drum 20 according to the first direction, while enabling the rotation of the main drum 20 according to the second direction; and
- a main biasing means urging the main pawl 23 towards a blocking position in the notches 22 of the ratchet wheel 21.

Thus, this main blocking system can be displaced between:

- the locked configuration in which the main pawl 23 is engaged with a notch 22 of the ratchet wheel 21 and therefore with the main drum 20 so as to prevent the rotation of the main drum 20 in the first direction and enable the rotation of the main drum in the second direction; and
- the unlocked configuration in which the main pawl 23 is disengaged from the notches 22 of the ratchet wheel 21 and is therefore cleared from the main drum 20 so as to enable the rotation of the main drum 20 in the first direction.

It should be noted that the main pawl 23 is located at the rear of the main drum 20, and it is in the locked configuration positioned at least partially below a main plane PP parallel to the transfer jib and passing through the main axis AP.

The setting mechanical device 2 also comprises a secondary mechanism cooperating with the main mechanism 20, 21, 23 by the action of a displacement of the transfer carriage 10 piloted by the pilot unit,

- either to enable the rotation of the main drum 20 in the first direction for a release of the tension in the transfer cable 9 after an unlocking of the main pawl 23 of the main mechanism by the secondary mechanism;
- or to make the main drum 20 rotate in the second direction for an increase of the tension in the transfer cable 9.

For this purpose, the secondary mechanism comprises a secondary lever 30 pivotally mounted about the main axis AP and provided with a head 31 projecting beyond the ratchet wheel 21, above the main plane PP. This secondary lever 30 is pivoting independently from the main drum 20 and from the ratchet wheel 21. This secondary lever 30 has an arcuate general shape, with two parallel subplates 300 extending on either side of the main drum 20 and of the ratchet wheel 21, and these subplates 300 are joined by a branch which passes below the main drum 20. The free ends of the two subplates 300 form the head 31, and between these two subplates 300 is fastened a rod 301 forming a physical pivot axis parallel to the main axis AP.

This secondary mechanism also comprises a rear biasing means comprising two rear springs 32 (which are not systematically illustrated in the figures) which are mounted between a rear anchorage 12 on the frame 10 and two anchorage points 310 provided on the head 31, and more specifically provided on the respective free ends of the two subplates 300. These two rear springs 32 urge the secondary lever 30 pivotally backwards (pivoting to the left in FIGS. 5, 7, 12 and 15). The two anchorage points 310 are shifted on the rear in comparison with the rod 301.

A factory setting of the pre-stress of the two rear springs 32 allows, firstly, setting the desired final tension force, and, secondly, mechanically detecting a lack of tension in the transfer cable 9.

The secondary mechanism also comprises a means for adjusting the biasing force exerted by these two rear springs 32 on the secondary lever 30, such an adjustment means comprising a means for setting the distance of the rear anchorage 12 on the frame 10, for example by a screw system, thus allowing adjustably tensioning these rear springs 32.

This secondary mechanism comprises a secondary guide means comprising a roller 33 rotatably mounted on the head 31, and more specifically rotatably mounted around the rod 301 carried by the head 31 between the free ends of the two subplates 300, according to an axis parallel to the main axis AP.

This secondary mechanism comprises a secondary pawl 34 pivotally mounted on the head 31, and more specifically rotatably mounted around the rod 301 carried by the head 31 between the free ends of the two subplates 300, according to an axis parallel to the main axis AP. This secondary pawl 34 is disposed next to the roller 33. This secondary pawl 34 is adapted to come into engagement with the notches 22 of the ratchet wheel 21, atop of the ratchet wheel 21, so as to rotatably act on this ratchet wheel 21.

The secondary pawl 34 has an «L» like general shape with:

- a rear branch whose end is adapted to come into engagement with the notches 22 of the ratchet wheel 21, and also to bear on the secondary cam 35 described hereinbelow; and
- a front branch which extends forwards and substantially at a right angle with respect to the rear branch.

This secondary pawl 34 includes two «L» like subplates spaced apart from one another, which carry therebetween at a rear end a rod 343 adapted to come into engagement in the notches 22 and also to abut against the secondary cam 35 described hereinbelow.

This secondary mechanism comprises a pivotally mounted secondary cam 35 pivoting on the frame 10 about the transverse axis AT common to the main pawl 23. Hence, this secondary cam 35 is located at the rear of the main drum 20. For this purpose, the frame 10 comprises a bracket 13 at the rear of the main drum 20 and provided with two parallel flanges carrying a shaft defining the transverse axis AT and about which the secondary cam 35 and the main pawl 23 are pivotally mounted, side-by-side, between the two flanges of the bracket 13; the main pawl 23 being positioned opposite the ratchet wheel 21. This secondary cam 35 has a cam surface 351 turned forwards and upwards, opposite the secondary pawl 34 which has a width adapted to come into engagement in the ratchet wheel 21 and also bear on this cam surface 351 of the secondary cam 35. More specifically, it is actually the rod 343 which will come into engagement in the ratchet wheel 21 and also bear on this cam surface 351 of the secondary cam 35.

This secondary mechanism comprises a cam biasing spring 36 mounted between the frame 10, and more specifically the bracket 13, and the secondary cam 35, and which urges the secondary cam 35 towards a neutral position (shown in FIGS. 1 to 8), in which the secondary cam 35 has its cam surface 351 turned forwards and upwards.

This secondary mechanism comprises a coupling means between the main pawl 23 and the secondary cam 35, where this coupling means comprises a coupling spring 37 linking the main pawl 23 and the secondary cam 35. Moreover, the secondary cam 35 has an arcuate groove 350 within which slides a pin secured to the secondary pawl 23; this pin associated to the arcuate groove 350 may form all or part of the main biasing means urging the main pawl 23 towards a position of blocking into the notches 22 of the ratchet wheel 21. It is also possible to consider providing a main biasing spring so as to form all or part of this main biasing means.

This secondary mechanism also comprises a secondary biasing means formed by a secondary biasing spring 38 mounted between the secondary lever 30 and the secondary pawl 34, where the secondary lever 30 comprises one single attachment point 304 for this secondary biasing spring 38 whereas the secondary pawl 34 comprises two distinct attachment points for this secondary biasing spring 38, more specifically a first attachment point 341 provided on its front branch and a second attachment point 342 provided on its rear branch.

Thus, this secondary biasing spring 38 can be configured between:

a1 first configuration (shown in FIG. 4) associated to a detent configuration of the setting mechanical device 2, in which the secondary biasing spring 38 is attached on the first attachment point 341 and urges the secondary pawl 34 towards disengagement from the ratchet wheel 21; and

- a second configuration (shown in FIGS. 3 and 16) associated to a tensioned configuration of the setting mechanical device 2, in which the secondary biasing spring 38 is attached on the second attachment point 342 and urges the secondary pawl 34 towards engagement in the notches 22 of the ratchet wheel 21.

The setting mechanical device 2 can be configured in a working configuration in which no element on transfer jib acts on the secondary lever 30, and the secondary biasing spring 38 is preferably in its second configuration so that the secondary pawl 34 is in engagement in a notch 22 of the ratchet wheel 21 and the main pawl 23 is in engagement in another notch 22 of the ratchet wheel 21. In this working configuration, the setting mechanical device 2 stands still irrespective of the displacement of the transfer carriage 1 and results in a holding of the tension in the transfer cable 9. In this working configuration, the displacement of the transfer carriage 1 is piloted so as to perform the load transfer operations, without interacting with the setting mechanical device 2.

The setting mechanical device 2 can also be configured in a detent configuration (shown in FIGS. 4 to 15) in which, by the action of a displacement of the transfer carriage 10 piloted by the pilot unit according to a predefined first sequence of reciprocating displacement between the forward direction and the backward direction, the setting mechanical device 2 results in a release of the tension in the transfer cable 9.

In other words, in this detent configuration, by the action of a displacement of the transfer carriage 1 piloted by the pilot unit according to the first sequence of displacement, the secondary mechanism 30, 31, 32, 33, 34, 35, 36, 37, 38 is adapted to act on the main mechanism 20, 21, 23 to make it pass from a locked configuration into an unlocked configuration and to enable an actuation of the main mechanism 20 in the first direction for a release of the tension in the transfer cable 9 until a return in the locked configuration.

For this purpose, in the detent configuration, there is provided a first stop element 4 which is static with respect to the transfer carriage 10 and which is shaped so as to cooperate with the setting mechanical device 2 by the action of a displacement of the transfer carriage 1 according to the first sequence of displacement.

This first stop element 4 has an inverted «U» like general shape, or inverted fork, and has a front stop 41 and a rear stop 42 which extend opposite to one another so as to surround the roller 33; where the front stop 41 and the rear stop 42 are curved inwards at their ends and form the opposite branches of the «U».

This first stop element 4 is removably fastened, for example by screwing or bolting, on the transfer jib, at the jib root, in order to enable mounting this first stop element 4 in the detent configuration and enable removing this first stop element 4 in the working configuration.

The following description relates to this first sequence of displacement in the detent configuration, with reference to FIGS. 4 to 15, to enable acting, remotely and in particular in an automated manner, on the setting mechanical device 2 so as to result in a controlled release of the tension in the transfer cable 9.

The start of the first sequence of displacement corresponds to a start situation shown in FIGS. 4 and 5, and after having, where necessary, made the secondary biasing spring 38 pass from the second configuration (shown in FIG. 3) into the first configuration (shown in FIG. 4), in which:

- the main pawl 23 is engaged in a notch 22, called start main notch (black hatched in the figures), of the ratchet wheel 21;
- the first stop element 4 is in place with its front stop 41 and its rear stop 42 which surround the roller 33, and that after having displaced the transfer carriage 1 up to a referenced start position;
- the secondary lever 30 is tilted forwards, against the rear springs 32 (which are not systematically illustrated in the different FIGS. 4 to 15), by means of a bearing of the front of the roller 33 on the rear stop 42 of the first stop element 4;
- the secondary pawl 34 is cleared from a notch of the ratchet wheel 21, by the effect of the secondary biasing spring 38 in the second configuration which raises the secondary pawl 34.

Starting from this start situation, the setting mechanical device 2 is adapted to allow for a release of the tension in the transfer cable 9 by the action of a displacement of the transfer carriage according to the first sequence of displacement, as follows:

(1-a) a displacement of the transfer carriage in the forward direction (illustrated by the arrow AV in FIGS. 5 to 10) is adapted to result in the following successive phases:

- the secondary lever pivots backwards, by the effect of the rear springs 32 (as schematized by the arrow PR in FIGS. 5 to 7), until the secondary pawl 34, which is in disengagement from the ratchet wheel 21, bears on the cam surface 351 of the secondary cam 35 (as shown in FIG. 8), this secondary cam being initially in the neutral position by the effect of the cam biasing spring 36; then
- the rear stop 42 of the first stop element 4 separates from the front of the roller 33 and the front stop 41 then bears on the rear of the roller 33, which makes the secondary lever 30 pivot backwards again (as schematized by the arrow PR in FIG. 9), concomitantly with a downward pivoting of the secondary pawl 34 in the direction of the ratchet wheel 21 (as shown in FIG. 9), this secondary pawl 34 being guided on the cam surface 351 of the secondary cam 35, which at the same time makes the secondary cam 35 pivot according to an opening direction (clockwise direction in FIGS. 9 and 10) against the cam biasing spring 36, until the secondary pawl 34 bears against a notch 22 of the ratchet wheel 21 before being engaged and blocked at the bottom of the notch 22, called secondary notch, of the ratchet wheel 21 (as shown in FIG. 9);
- the secondary lever 30 stops pivoting backwards (as schematized by the arrow PR in FIG. 10), resulting in a push of the secondary pawl 34 into the secondary notch 22 which makes the ratchet wheel 21 (and therefore also the main drum 20) rotate according to the second direction (as schematized by the arrow S2 in FIGS. 9 and 10), thereby releasing the main pawl 23 from the start main notch 22 in which it is engaged, and the bearing of the secondary pawl 34 on the secondary cam 35 keeps pivoting the secondary cam according to an opening direction against the cam biasing spring 36, and by rotating, this secondary cam 35 makes the main pawl 23 pivot, via the coupling spring 37, so that the main pawl 23 released beforehand moves away from the ratchet wheel 21 until the main blocking system is in the unlocked configuration (as shown in FIG. 10);

(1-b) a displacement of the transfer carriage in the backward direction (illustrated by the arrow AR in FIGS. 11 to 15) is adapted to result in the following successive phases:

- following the unlocking of the main pawl 23, the main drum 20 and the ratchet wheel 21 pivoting in the first direction (as schematized by the arrow S1 in FIGS. 11 and 12) by the effect of a force exerted by the front strand of the transfer cable 9 on the main drum 20, causing the pivoting of the secondary lever 30 forwards (as schematized by the arrow PV in FIGS. 11 and 12) because the ratchet wheel 21 pushes on the secondary pawl 34, the roller 33 remains in contact with the front stop 41 of the first stop element 4 and the rear springs 32 do not resist this forward pivoting of the secondary lever; and
- concomitantly with the backward pivoting of the secondary lever 30, the secondary cam 35 pivots according to a closure direction (counterclockwise direction in FIGS. 11 to 13), opposite to the opening direction, by the effect of the cam biasing spring 36, which lets the main pawl 23 return into contact with the ratchet wheel 21 (as schematized by the arrow RE in FIG. 12) by the effect of the main biasing spring and also of the pin which is pushed into the arcuate groove 350 of the secondary cam 35, until this main pawl 23 is engaged with a new notch 22, called end main notch, which is located after the start main notch (the black hatched notch in FIGS. 7 to 14) according to the first direction (as shown in FIG. 13), for a release of the tension in the transfer cable 9, and which blocks the rotation of the main drum 20 according to the first direction after having «gained» a detent or release notch; then the front stop 41 of the first stop element 4 separates from the front of the roller 33 and the rear stop 42 of the first stop element 4 then bears on the rear of the roller 33, which makes the secondary lever 30 pivot backwards again until the secondary pawl 34 disengages from the ratchet wheel 21 by the effect of the secondary biasing spring 38 (as shown in FIG. 14) for a return into a start situation.

Of course, this first sequence of displacement may be repeated to increment each time a release of the tension in the transfer cable 9, until reaching a predefined tension low threshold. It is thus advantageous to use one or several sensor(s) to access at least one parameter representative of the tension in the transfer cable 9 in order to carry on or stop the detent operation depending on the value of this parameter.

It should be noted that it is advantageous to provide for a check-up of the configuration of the setting mechanical device 2 in the detent configuration (checking up that the secondary biasing spring 38 is in the first configuration, that the first stop element 4 is in place and that the transfer carriage 1 is positioned so that the first stop element 4 surrounds the roller 33) before starting the piloting by the pilot unit of the displacement of the transfer carriage 1 according to the first sequence of displacement.

The setting mechanical device 2 can also be configured in a tensioned configuration (shown in FIGS. 16 and 17) in which, by the action of a displacement of the transfer carriage piloted by the pilot unit according to a predefined second sequence of reciprocating displacement between the forward direction and the backward direction, the setting mechanical device 2 results in an increase of the tension in the transfer cable 9.

In other words, in this tensioned configuration, by the effect of a displacement of the transfer carriage 1 piloted by the pilot unit according to the second sequence of displacement, the secondary mechanism 30, 31, 32, 33, 34, 35, 36, 37, 38 is adapted to actuate the main mechanism 20, 21, 23 and more specifically the main drum 20 in the second direction for an increase of the tension in the transfer cable 9.

For this purpose, in the tensioned configuration, there is provided a second stop element 5 which is static with respect to the transfer carriage 10 and which is shaped so as to cooperate with the setting mechanical device 2 by the action of a displacement of the transfer carriage 1 according to the second sequence of displacement.

This second stop element 5 has an inclined front face 51 forming a ramp, extended by a longitudinal lower face 52 extending parallel to the transfer jib.

This second stop element 5 is removably fastened, for example by screwing or bolting, on the transfer jib, at the jib root, in order to enable mounting this second stop element 5 in the tensioned configuration and enable removing this second stop element 5 in the working configuration. Advantageously, the first stop element 4 and the second stop element 5 are mounted at the same location on the transfer jib respectively in the detent configuration and in the tensioned configuration.

The following description relates to this second sequence of displacement in the tensioned configuration, partially with reference to FIGS. 16 and 17, in order to enable acting, remotely and in particular in an automated manner, on the setting mechanical device 2 so as to result in a controlled increase of the tension in the transfer cable 9.

The start of the second sequence of displacement corresponds to a start situation (which almost corresponds to the situation illustrated in FIGS. 1 to 3 except for what concerns the first stop element 4 which is absent) in which:

the main pawl is engaged in a notch 22, called start main notch, of the ratchet wheel 21;

the secondary biasing spring 38 is in the second configuration (as shown in FIG. 16);

the secondary pawl 34 is engaged in a notch 22, called start secondary notch, of the ratchet wheel 21, and this secondary pawl 34 is constrained in this secondary notch 22 by the effect of the rear springs 32 (which are not entirely illustrated in these FIGS. 16 and 17); and the second stop element 5 is in place, and the transfer carriage 1 is away forwards with respect to this second stop element 5.

Starting from this start situation, the setting mechanical device 2 is adapted to allow for an increase of the tension in the transfer cable 9 by the action of a displacement of the transfer carriage according to the second sequence of displacement, as follows:

(2-a) a displacement of the transfer carriage in the backward direction (illustrated by the arrow AR in FIGS. 16 and 17) is adapted to result in the following successive phases:

the roller 33 bears on the inclined front face 51 of the second stop element 5, making the secondary lever 30 pivot forwards (as schematized by the arrow PV in FIGS. 16 and 17), against the rear springs 32, until the roller 33 bears on the longitudinal lower face 52 of the second stop element 5;

the forward pivoting of the secondary lever urges the secondary pawl 34, which is biased against the ratchet wheel 21 by the secondary biasing spring 38, to leave a start secondary notch 22 so as to pass into an end secondary notch located before the start secondary notch according to the first direction;

and afterwards (2-b) a displacement of the transfer carriage in the forward direction is adapted to result in the following successive phases:

the roller 33 separates from the longitudinal lower face 52 of the second stop element 5, and bears on the inclined front face 51 of the second stop element 5, enabling the secondary lever 30 to pivot backwards by the effect of the rear springs 32;

the backward pivoting of the secondary lever 30 urges the secondary pawl 34 to exert a push in the bottom of the end secondary notch 22, causing a rotation of the ratchet wheel 21 and of the main drum 20 according to the second direction, and the main pawl 23 leaves the start main notch so as to pass into an end main notch located before the start main notch according to the first direction, for an increase of the tension in the transfer cable 9, which translates in a «gain» of a tension notch.

Of course, this second sequence of displacement may be repeated to increment each time an increase of the tension in the transfer cable 9, until reaching a predefined tension high threshold. It is thus advantageous to use one or several sensor(s) to access at least one parameter representative of the tension in the transfer cable 9 in order to carry on or stop the tensioning operation depending on the value of this parameter.

It should be noted that it is advantageous to provide for a check-up of the configuration of the setting mechanical device 2 in the tensioned configuration (checking up that the secondary biasing spring 38 is in the second configuration and that the second stop element 5 is in place) before starting the piloting by the pilot unit of the displacement of the transfer carriage 1 according to the second sequence of displacement.

Advantageously, the tensioning operation comprises a step of resetting a reference position of the transfer carriage when the stop has returned into the start of travel following the second displacement of the transfer carriage.

It should be noted that the tensioning operation is performed only on the front strand of the transfer cable 9, which is that one passing though the jib tip. Also, once the desired increase of tension is reached, it is advantageous to displace the transfer carriage 1 forwards (towards the jib tip) by an average value equal to half the length of the wound transfer cable 9, and then backwards, to distribute the tension between the front strand and the rear strand. This displacement may be automatically made at the end of the tensioning operation.

Thus, the tensioning operation allows automatically re-tracking the «zero range» of the transfer carriage 1 which corresponds to the reference position of the transfer carriage to determine its position along the jib. After the automation of this re-tracking, the risk of error on this reference position is eliminated and the range indication will always remain correct and reliable.

Thus, the tension setting system, which comprises, as a reminder, the setting mechanical device 2, the transfer winch and the pilot unit, allows remotely (possibly in an automated manner by means of an autopilot module) controlling the displacement of the transfer carriage 1, and thus acting on the setting mechanical device 2, via the first stop element 4 or the second stop element 5 fastened beforehand on the transfer jib, so as to result in a release of the tension in the transfer cable 9 or an increase of the tension in the transfer cable 9.

Consequently, the invention has many technical advantages:

- an automation of the detent operation and therefore of the release of the tension of the transfer cable 9, with a crane operation who triggers the first sequence of displacement;
- an automation of the tensioning operation and therefore of the increase of the tension of the transfer cable 9, with an accuracy with regards to the tension in the transfer cable 9;
- an automated tension setting system which allows limiting and mastering the force in the transfer cable 9 (without any risk of excessive tension and loose tension);
- an automated and easy-to-use detent, which will allow reduce risks during a dismount of the crane;
- an automated and easy-to-use tensioning, which will allow reducing the risk of working with a loose transfer cable 9 which might cause the triggering of a loose cable safety device;
- an automation which allows performing tensioning more often than before, thereby improving the displacement of the transfer carriage 1 which will be more reactive and more accurate because there would be no longer a looseness of the cable to be tensioned before triggering the displacement of the transfer carriage 1;
- an automated tensioning which allows replacing the manual intervention of an external maintenance operator through an easier, effort-less and autonomous action of the crane operator, also improving safety during the use of the crane;
- an automation of the movements which allows transferring a portion of the responsibilities assigned before to the external maintenance operators, to the proper course of the first or second sequence and therefore to the operator of the crane which translates in the proper operation of the movements and in the reliability of the components and of the tension setting system;
- an automation which allows reducing maintenance costs, reducing maintenance downtimes and therefore increasing the productivity on the construction site and improving the operating costs of the crane, and therefore a better profitability for the construction project owner;
- an automated reset of the reference position of the transfer carriage 1, which thus allows always indicating proper values of the range of the load on a pilot screen, these values remaining accurate may thus be repeated in a process for monitoring and controlling the crane.

What is claimed is:

1. A tension setting system for a remote setting of a tension in a transfer cable ensuring a displacement of a transfer carriage displaceable along a transfer jib of a crane, said tension setting system comprising:

- a transfer winch equipped with a transfer motor and cooperating with the transfer cable so as to ensure a displacement of the transfer carriage in a forward direction and in a backward direction;
- a pilot unit connected to the transfer motor to remotely pilot a displacement of the transfer carriage in the forward direction and in the backward direction; and
- a setting mechanical device mounted on the transfer carriage and adapted to be actuated by the action of a displacement of the transfer carriage, said setting mechanical device being coupled to the transfer cable and configurable between:
  - a working configuration in which the setting mechanical device stands still irrespective of the displacement of the transfer carriage and results in a holding of the tension in the transfer cable; and
  - a detent configuration in which, by the action of a displacement of the transfer carriage piloted by the pilot unit according to a predefined first sequence of reciprocating displacement between the forward direction and the backward direction, the setting mechanical device results in a release of the tension in the transfer cable.

2. The tension setting system according to claim 1, wherein the setting mechanical device can also be configured in a tensioned configuration in which, by the action of a displacement of the transfer carriage piloted by the pilot unit according to a predefined second sequence of reciprocating displacement between the forward direction and the backward direction, the setting mechanical device results in an increase of the tension in the transfer cable.

3. The tension setting system according to claim 2, wherein, in the detent configuration of the setting mechanical device, the tension setting system further comprises a first stop element which is static with respect to the transfer carriage and which is shaped so as to cooperate with the setting mechanical device by the action of a displacement of the transfer carriage according to the first sequence of displacement, and wherein, in the tensioned configuration of the setting mechanical device, the tension setting system further comprises a second stop element which is static with respect to the transfer carriage and which is shaped so as to cooperate with the setting mechanical device by the action of a displacement of the transfer carriage according to the second sequence of displacement.

4. The tension setting system according to claim 3, wherein the second stop element is removably fastened on the transfer jib in order to enable mounting said second stop element in the tensioned configuration and enable removing said second stop element in the working configuration and in the detent configuration.

5. The tension setting system according to claim 1, wherein the pilot unit comprises an autopilot module configured to automatically implement the first sequence of displacement once the setting mechanical device is in the detent configuration in order to automatically implement a release of the tension in the transfer cable.

6. The tension setting system according to claim 1, wherein the setting mechanical device comprises a main mechanism coupled to the transfer cable and actuatable in a first direction for a release of the tension in the transfer cable and in a second direction for an increase of the tension in the transfer cable, said main mechanism being configurable between a locked configuration adapted to prevent an actuation in the first direction and to enable an actuation in the second direction, and an unlocked configuration adapted to enable an actuation in the second direction by the effect of the tension in the transfer cable, and wherein the setting mechanical device further comprises a secondary mechanism cooperating with the main mechanism by the action of a displacement of the transfer carriage piloted by the pilot unit, either to actuate said main mechanism in the first direction for a release of the tension in the transfer cable after an unlocking of the main mechanism by said secondary mechanism;

or to actuate said main mechanism in the second direction for an increase of the tension in the transfer cable when the setting mechanical device is in the tensioned configuration.

7. The tension setting system according to claim 6, wherein the secondary mechanism is configurable between:

the detent configuration in which, by the action of a displacement of the transfer carriage piloted by the pilot unit according to the first sequence of displacement, the secondary mechanism is adapted to act on the main mechanism to make it pass from a locked configuration into an unlocked configuration and to enable an actuation of the main mechanism in the first direction for a release of the tension in the transfer cable until a return in the locked configuration;

the tensioned configuration in which, by the effect of a displacement of the transfer carriage piloted by the pilot unit according to the second sequence of displacement, the secondary mechanism is adapted to actuate the main mechanism in the second direction for an increase of the tension in the transfer cable.

8. The tension setting system according to claim 6, wherein the main mechanism comprises a main drum rotatably mounted according to a main axis and around which the transfer cable is partially wound so that, on the one hand, a rotation of the main drum according to the first direction causes an unwinding of the transfer cable translating in a release of the tension in the transfer cable and, on the other hand, a rotation of the main drum according to the second direction, opposite to the first direction, results in a winding of the transfer cable translating in an increase of the tension in the transfer cable;

and wherein the main mechanism further comprises a main blocking system displaceable between:

the locked configuration in which the main blocking system is engaged with the main drum to prevent the rotation of the main drum in the first direction and enable the rotation of the main drum in the second direction; and the unlocked configuration in which the main blocking system is cleared from the main drum to enable the rotation of the main drum in the first direction.

9. The tension setting system according to claim 8, wherein the main blocking system comprises:

a ratchet wheel secured in rotation with the main drum and provided at the periphery thereof with a series of notches of the unidirectional notch type;

a main pawl pivotally mounted and adapted to be blocked in the notches of the ratchet wheel to prevent the rotation of the main drum according to the first direction, while enabling the rotation of the main drum according to the second direction; and a main biasing means urging the main pawl towards a blocking position in the notches of the ratchet wheel;

and wherein the secondary mechanism comprises:

a secondary lever pivotally mounted about the main axis and provided with a head projecting beyond the ratchet wheel, and said secondary lever being coupled to a rear biasing means which urges the secondary lever backwards;

a secondary guide means mounted on the head;

a secondary pawl pivotally mounted on the head of the secondary lever and adapted to come into engagement with the notches of the ratchet wheel to act in rotation on this ratchet wheel;

a secondary cam pivotally mounted and having a cam surface, said secondary cam being coupled to the main pawl via a coupling means, and said secondary cam being coupled to a cam biasing means which urges the secondary cam towards a neutral position;

a secondary biasing means mounted between the secondary lever and the secondary pawl, said secondary biasing means being configurable between:

a first configuration associated to the detent configuration of the setting mechanical device, in which the secondary biasing means urges the secondary pawl towards disengagement from the ratchet wheel; and a second configuration associated to the tensioned configuration of the setting mechanical device, in which the secondary biasing means urges the secondary pawl towards engagement in the notches of the ratchet wheel.

10. The tension setting system according to claim 1, wherein, in the detent configuration of the setting mechanical device, the tension setting system further comprises a first stop element which is static with respect to the transfer carriage and which is shaped so as to cooperate with the setting mechanical device by the action of a displacement of the transfer carriage according to the first sequence of displacement.

11. The tension setting system according to claim 10, wherein the first stop element has a front end and a rear stop which extend opposite to one another so as to surround the secondary guide means.

12. The tension setting system according to claim 10, wherein the first stop element is removably fastened on the transfer jib in order to enable mounting said first stop element in the detent configuration and enable removing said first stop element in the working configuration.

13. The tension setting system according to claim 1, further comprising at least one sensor for measuring at least one of the following parameters: tension in the transfer cable, configuration of the setting mechanical device, position of the transfer carriage, position of a constitutive member of the setting mechanical device.

14. A crane comprising:

a transfer carriage displaceable along a transfer jib by means of a transfer cable, and a tension setting system for a remote setting of a tension in the transfer cable ensuring a displacement of the transfer carriage displaceable along the transfer jib, said tension setting system comprising:

a transfer winch equipped with a transfer motor and cooperating with the transfer cable so as to ensure a displacement of the transfer carriage in a forward direction and in a backward direction;

a pilot unit connected to the transfer motor to remotely pilot a displacement of the transfer carriage in the forward direction and in the backward direction; and a setting mechanical device mounted on the transfer carriage and adapted to be actuated by the action of a displacement of the transfer carriage, said setting mechanical device being coupled to the transfer cable and configurable between:

a working configuration in which the setting mechanical device stands still irrespective of the displacement of the transfer carriage and results in a holding of the tension in the transfer cable; and a detent configuration in which, by the action of a displacement of the transfer carriage piloted by the pilot unit according to a predefined first sequence of reciprocating displacement between the forward direction and the backward direction, the setting mechanical device results in a release of the tension in the transfer cable.

15. A tension setting method for a remote setting of a tension in a transfer cable ensuring a displacement of a transfer carriage displaceable along a transfer jib of a crane, the crane having a tension setting system comprising:

a transfer winch equipped with a transfer motor and cooperating with the transfer cable so as to ensure displacement of the transfer carriage in a forward direction and in a backward direction;

a pilot unit connected to the transfer motor to remotely pilot displacement of the transfer carriage in the forward direction and in the backward direction; and a setting mechanical device mounted on the transfer carriage and adapted to be actuated by the action of displacement of the transfer carriage, said setting mechanical device being coupled to the transfer cable and configurable between:

a working configuration in which the setting mechanical device stands still irrespective of the displacement of the transfer carriage and results in a holding of the tension in the transfer cable; and a detent configuration in which, by the action of a displacement of the transfer carriage piloted by the pilot unit according to a predefined first sequence of reciprocating displacement between the forward direction and the backward direction, the setting mechanical device results in a release of the tension in the transfer cable, said tension setting method implementing a detent operation for a release of tension in the transfer cable, the method comprising:

a configuration of the setting mechanical device in the detent configuration, followed by a piloting by the pilot unit of the displacement of the transfer carriage according to the first sequence of displacement to act on the setting mechanical device and result in a release of the tension in the transfer cable.

16. The tension setting method according to claim 15, wherein the pilot unit comprises an autopilot module, and wherein, during the detent operation, the piloting by the pilot unit of the displacement of the transfer carriage according to the first sequence of displacement is automatically implemented by the autopilot module.

17. The tension setting method according to claim 15, wherein, during the detent operation, the piloting by the pilot unit of the displacement of the transfer carriage according to the first sequence of displacement implements several successive first sequences of displacement until the tension in the transfer cable falls below a predefined low threshold.

18. The tension setting method according to claim 15, wherein, during the detent operation, there is provided for a check-up of the configuration of the setting mechanical device in the detent configuration, before starting the piloting by the pilot unit of the displacement of the transfer carriage according to the first sequence of displacement.

19. The tension setting method according to claim 15, wherein the setting mechanical device can also be configured in a tensioned configuration, said tension setting method implementing a tensioning operation for an increase of the tension in the transfer cable and comprising:

a configuration of the setting mechanical device in the tensioned configuration, followed by a piloting by the pilot unit of the displacement of the transfer carriage according to a second sequence of displacement to act on the setting mechanical device and result in an increase of the tension in the transfer cable.

20. The tension setting method according to claim 19, wherein, during the tensioning operation, there is provided for a check-up of the configuration of the setting mechanical device in the tensioned configuration, before starting the piloting by the pilot unit of the displacement of the transfer carriage according to the second sequence of displacement.

* * * * *